US007225948B2

(12) United States Patent
Ophardt et al.

(10) Patent No.: US 7,225,948 B2
(45) Date of Patent: Jun. 5, 2007

(54) SELF-ORIENTATING PUMP NOZZLE FOR FLUID DISPENSER

(75) Inventors: Heiner Ophardt, Vineland (CA); Srdjana Jankovic, Hamilton (CA)

(73) Assignee: Hygiene-Technik Inc., Beamsville (CA)

( * ) Notice: Subject to any disclaimer, the term of this patent is extended or adjusted under 35 U.S.C. 154(b) by 578 days.

(21) Appl. No.: 10/810,604

(22) Filed: Mar. 29, 2004

(65) Prior Publication Data

US 2005/0205608 A1 Sep. 22, 2005

(30) Foreign Application Priority Data

Mar. 17, 2004 (CA) ..... 2461225

(51) Int. Cl.
*B67D 5/06* (2006.01)

(52) U.S. Cl. ..... 222/181.3; 222/383.1

(58) Field of Classification Search ..... 222/181.3, 222/182, 183, 321.1, 321.9, 185.1, 382.1, 222/385, 325, 327, 340, 383.1, 321.7, 100–107, 222/131, 173, 621, 628, 181.1, 181.2, 383.2, 222/383.3, 384

See application file for complete search history.

(56) References Cited

U.S. PATENT DOCUMENTS 4,036,406 A * 7/1977 Jespersen et al. ..... 222/181.2
4,164,306 A * 8/1979 Perrin ..... 222/181.2
4,238,056 A * 12/1980 Tucker et al. ..... 222/181.2
4,437,584 A 3/1984 Connors
5,282,552 A 2/1994 Ophardt
5,431,309 A 7/1995 Ophardt
5,465,877 A * 11/1995 Bell et al. ..... 222/181.2
5,489,044 A 2/1996 Ophardt
5,556,005 A * 9/1996 Banks ..... 222/96
5,638,989 A 6/1997 Ophardt
5,676,277 A 10/1997 Ophardt
5,975,360 A 11/1999 Ophardt
6,068,162 A 5/2000 De Winter
6,082,586 A * 7/2000 Banks ..... 222/95
6,131,773 A * 10/2000 Wade et al. ..... 222/153.02
6,409,050 B1 6/2002 Ophardt
6,533,145 B1 * 3/2003 Lewis et al. ..... 222/181.3
7,066,357 B1 * 6/2006 Ciavarella et al. ..... 222/156
2005/0087552 A1 * 4/2005 Ciavarella et al. ..... 222/181.1

FOREIGN PATENT DOCUMENTS

GB 191655 1/1923
GB 201053 7/1923
GB 283644 1/1928
GB 411573 6/1934

* cited by examiner

*Primary Examiner*—Lien M. Ngo
(74) *Attorney, Agent, or Firm*—Riches,McKenzie & Herbert LLP

(57) ABSTRACT

A replaceable fluid container carrying a spray pump with a nozzle which directs spray directionally in which an arrangement is provided for orientating the nozzle into a desired orientation on insertion of the container into a dispenser.

18 Claims, 22 Drawing Sheets

8
26
30
62
60
38
34
42
4
43
32
33
72a
40
44
6
64a
54a
46
72b
64b
14
66
10
24
28
86
78
17
22
20
16
12
18

SELF-ORIENTATING PUMP NOZZLE FOR FLUID DISPENSER

SCOPE OF THE INVENTION

This invention relates to fluid dispensers and, more particularly, to a fluid dispenser with a nozzle which is self-orientating to direct fluid in the desired direction with insertion of a pump carrying the nozzle into a dispenser.

BACKGROUND OF THE INVENTION

Fluid dispensers such as disclosed in U.S. Pat. No. 5,431,309 issued Jul. 11, 1995 are known in which a liquid to be dispensed is contained in a disposable container which incorporates a pump assembly. Typically, the pump assembly includes a reciprocally movable piston which, when moved, dispenses a quantity of liquid from the container. The containers are fitted within a permanent dispenser housing which includes a movable actuator assembly which secures and reciprocally moves the movable element to dispense the fluid. Once the fluid in the disposable container has been exhausted, the disposable container is replaced by another disposable container incorporating an identical pump assembly.

U.S. Pat. No. 5,431,309 provides a construction which permits simplified replacement of a fluid container incorporating a pump assembly with a piston movable between extended and retracted positions. The patent provides an arrangement whereby whether the piston is in an extended or a retracted position, after insertion of the container into the permanent housing, cycling of the movable actuator assembly secures the piston in a desired coupled arrangement with the movable actuator assembly. The patent provides that when inserted such that the piston may not initially be in the desired coupled arrangement that after an initial cycling of the movable actuator assembly, the piston comes to be properly coupled.

Liquid dispensers such as the type illustrated in U.S. Pat. No. 5,431,304 are known as adapted for dispensing a wide variety of fluids including fluids of relatively low viscosity such as water-like fluids, aqueous alcohol solutions and alcohol and in which a nozzle is provided at the end of the pump so as to provide a spray pump which emits an atomized cone of the liquid onto a user's hand. The present applicant has appreciated disadvantages with such spray pumps in that the atomized cone of the liquid being dispensed may be directed in directions which are not desired. For example, a cone of spray may spray liquid onto a wall on which the dispenser is mounted or onto a movable actuator, typically a presser bar, which is manually moved to dispense the liquid. This has been appreciated to cause a liquid build up on the wall or presser bar which can be messy and can drip off after use. This has a disadvantage that the dripping can cause a user to assume that the dispenser is leaking. As well, the dripping is messy and can cause unsightly build up on a surface onto which the liquid is sprayed or dripped and, as well, can cause slippery conditions if the liquid drips onto a floor surface.

SUMMARY OF THE INVENTION

To at least partially overcome these disadvantages of known fluid dispenser, the present invention provides a replaceable fluid container carrying a spray pump with a nozzle which directs spray directionally in which an arrangement is provided for orientating the nozzle into a desired orientation on insertion of the container into a dispenser. In a preferred aspect of the invention, with replacement of the disposable container into a permanent housing, the spray pump and its nozzle will automatically be self-orientating.

An object of the present invention is to provide an improved fluid dispenser with a spray pump having a nozzle which restricts the relative sector into which fluid is sprayed relative to the dispenser.

Another object is to provide a replaceable pump with a nozzle which is adapted to be disposed in preferred orientations relative to a permanent housing and in which interaction between the pump and the permanent housing renders, on insertion of the pump into the permanent housing, for the nozzle to adopt a preferred orientation.

BRIEF DESCRIPTION OF THE DRAWINGS

Further aspects and advantages of the invention will appear from the following description taken together with the accompanying drawings in which.

DETAILED DESCRIPTION OF THE DRAWINGS

Figure 1:
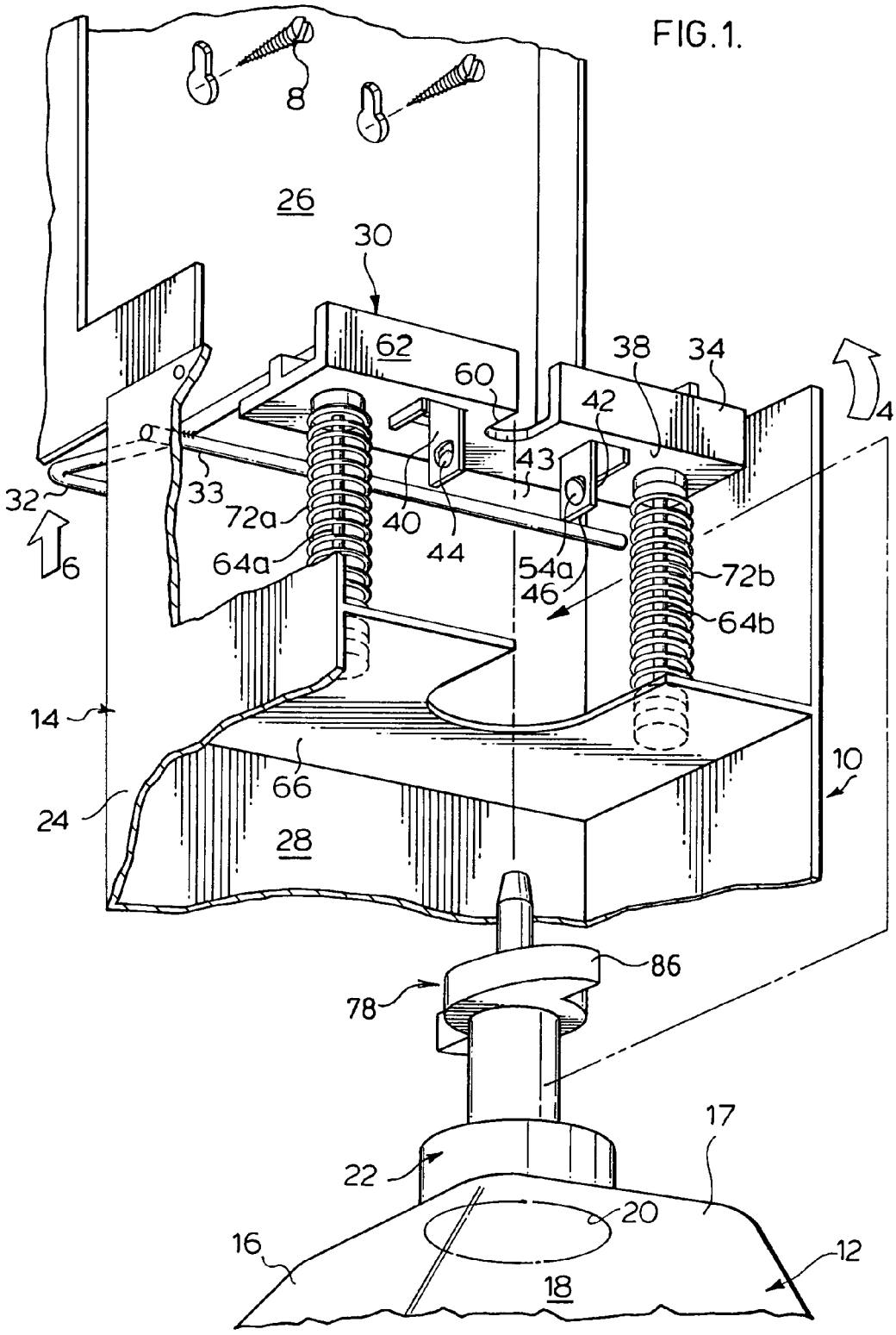
FIG. 1 is an exploded partial perspective view of a preferred embodiment of a housing and reservoir in accordance with the invention with the housing open for reservoir insertion.

Reference is made first to FIG. 1 which shows a dispenser 10 in accordance with a preferred embodiment of the invention. The dispenser 10 comprises a reservoir 12, and a housing 14.

The reservoir 12 comprises a chamber 16 for holding fluid 18 as, for example, an aqueous alcohol solution which is to be dispensed. An outlet 20 is provided through a lowermost wall 17 of the chamber 16, across which is located a valve assembly 22 to regulate the flow of fluid 18 outwardly therethrough. Preferably, the reservoir 12 is made entirely of plastic and is disposable once the supply of fluid 18 is exhausted.

FIG. 1 shows the housing 14 in an open configuration, ready for insertion of the reservoir 12. The housing 14 includes a cover 24 which is hingedly connected to a backplate 26 adapted for permanent attachment to a wall by screws 8 or other known means. The cover 24 pivots relative to the backplate 26 about hinge pivot 25 in a known manner from the open position, which permits removal and replacement of the reservoir 12 in the direction of arrow 4 to a closed position wherein the dispenser may be used to dispense fluid 18. With the cover 24 open to the piston shown in FIG. 1, the reservoir 12 is inserted into the housing 14 with the outlet 20 oriented upwardly. The movement of the cover 24 to the closed position inverts the reservoir 12 so that the outlet 20 is reoriented downwards ready to dispense fluid 18.

The cover 24 is formed having a generally box-like shape so as to define a reservoir cavity 28 in which the reservoir 12 is housed. With the reservoir 12 inserted in the cavity 28, the cover 24 is closed moving the reservoir 12 to a dispensing position wherein the fluid 18 may be dispensed outwardly via the opening 20 and valve assembly 22. An actuator assembly 30 is provided in the housing 14, movable relative to the cover 24 to activate a movable piston element 78 of the valve assembly 22 and effect fluid 18 dispensation.

Figure 2:
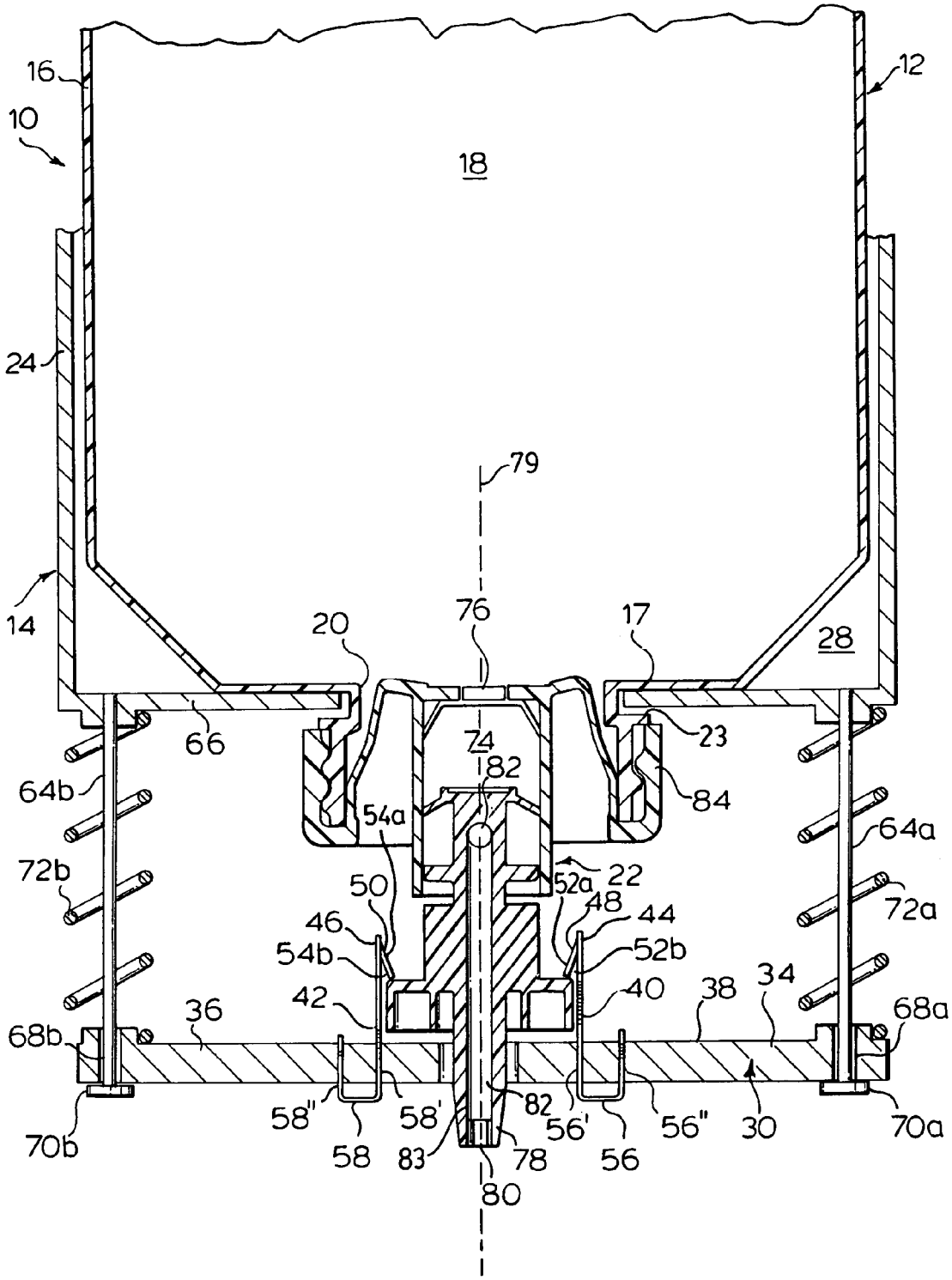
FIG. 2 is a partial cross sectional view of the preferred embodiment of the housing and reservoir of FIG. 1 with the housing closed in a coupled first orientation with the actuator assembly and the reciprocally movable piston element in an extended position.
Figure 3:
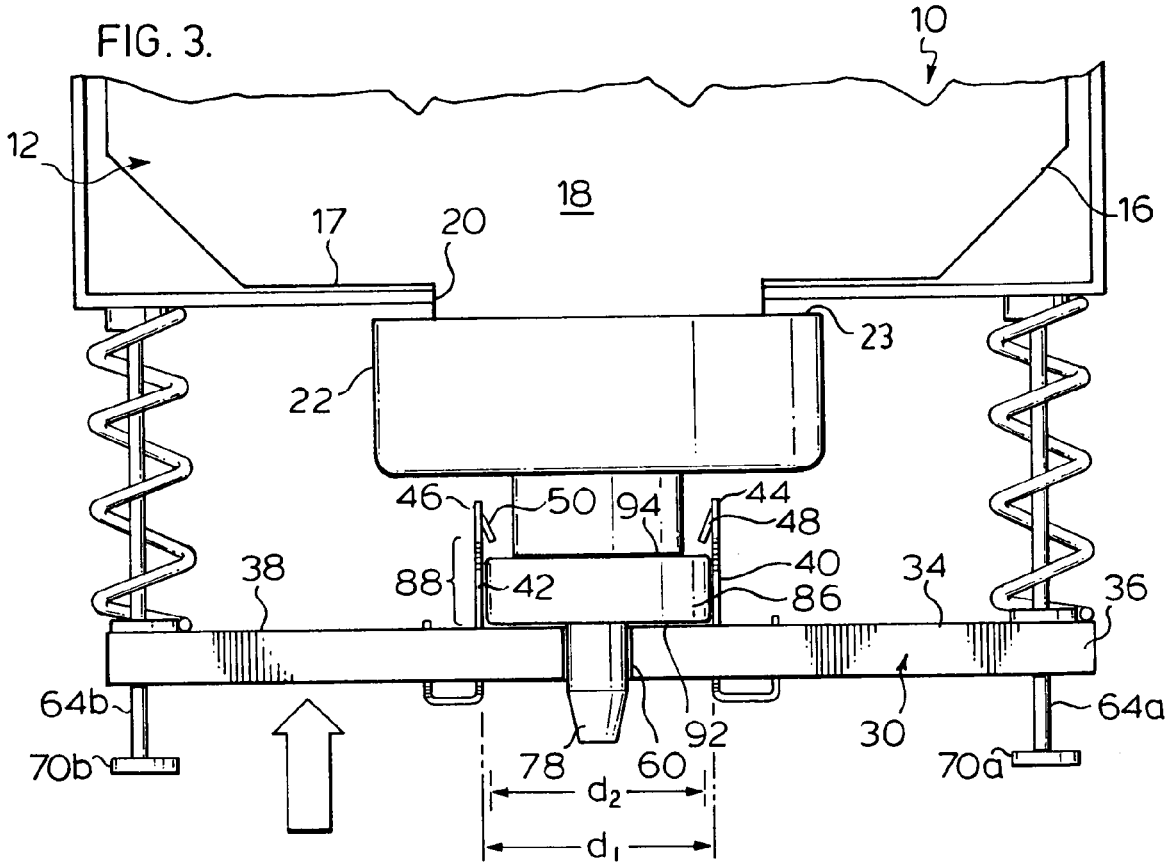
FIG. 3 is a partial perspective view of the reservoir and housing of FIG. 1 with the housing closed in a coupled first orientation with the activator assembly and piston element in a retracted position.

With the piston element 78 in a coupled orientation relative to the actuator assembly 30 to dispense fluid, the piston element 78 is reciprocated between an extended position shown in FIG. 2 and a retracted position shown in FIG. 3.

The actuator assembly 30 includes a lever 32 which is pivotally connected to the cover 24, and a catch assembly 34. The catch assembly 34 is adapted for engaging and securing part of the piston element 78 thereto. The lever 32 pivots in the direction of arrow 6 in FIG. 1 about the axis of a metal rod 33 which extends across the cover 24. One end of the lever 32 abuttingly contacts the catch assembly 34 such that pivotal movement of the lever 32 moves the catch assembly 34 between an extended position spaced from the reservoir 12 as seen in FIG. 2, and a retracted position wherein the catch assembly 34 is moved toward the reservoir 12 as seen in FIG. 3.

Figure 4:
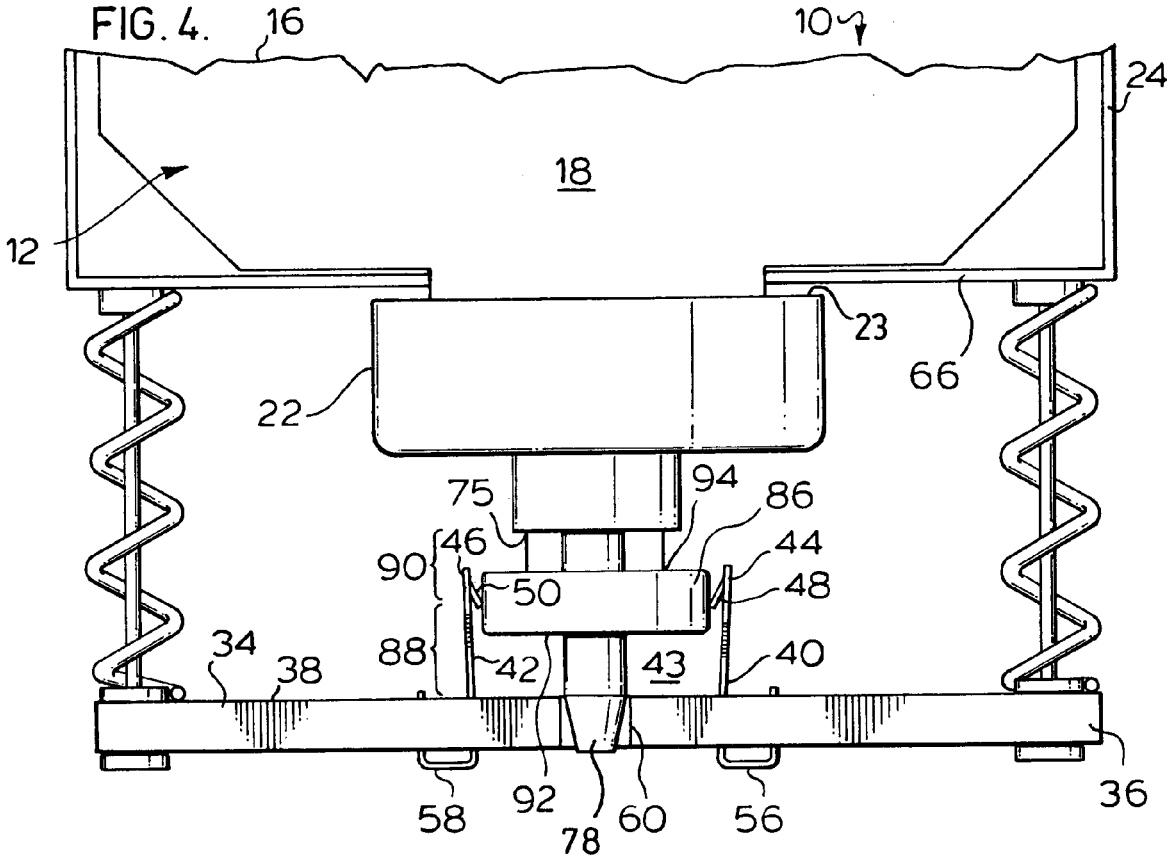
FIGS. 4 and 5 show partial perspective views of the housing and reservoir of FIG. 1 with the housing closed in respective uncoupled second and third orientations and with the actuator assembly and piston element in the extended position.
Figure 5:
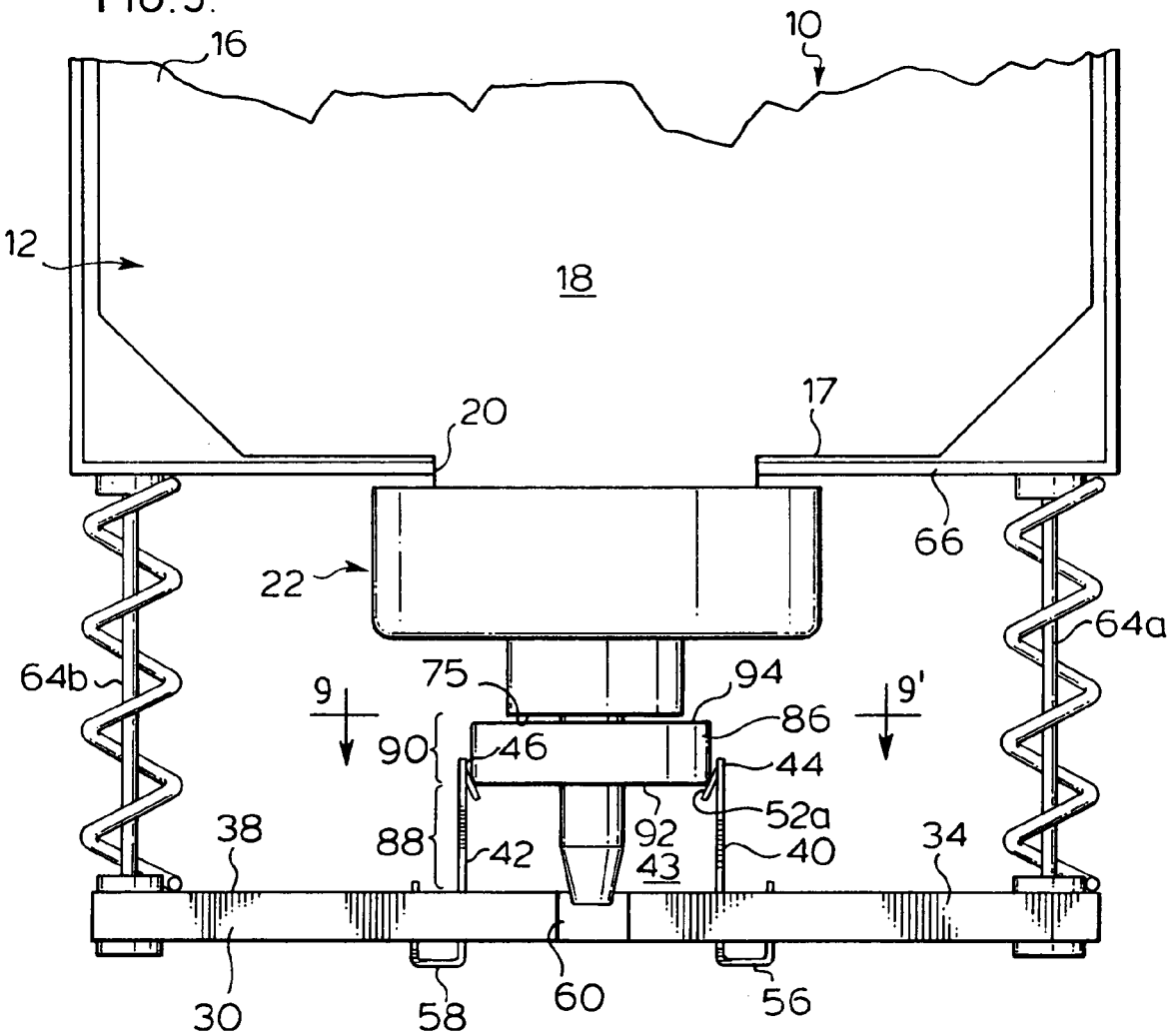

As will be described in greater detail hereafter, the actuator assembly 30 permits the horizontal sliding insertion of the reciprocally movable piston element 78 into the catch assembly 34 either into an orientation where the catch assembly 34 and piston element 78 are coupled for movement together, as shown in FIGS. 2 and 3, or an uncoupled orientation where the catch assembly 34 may move independently from the piston element 78, as shown in FIGS. 4 and 5.

In the coupled orientation, the pivotal movement of the lever 32 axially moves the catch assembly 34 and piston element 78 between the extended position and the retracted position to dispense a quantity of fluid 18. If the reservoir 12 is inserted with the piston element 78 in the uncoupled orientation of FIGS. 4 and 5, in a manner later described, the first movement of the lever 32 moves the catch assembly 34 relative to the piston element 78 until the catch assembly 34 engages the piston element 78 and assumes the coupled orientation of FIG. 2. In this manner, the dispenser 10 is operative to dispense fluid 18 regardless of whether the piston element 78 is initially inserted into the housing 14 to be either in the coupled or uncoupled orientation to the catch assembly 34.

Figure 10:
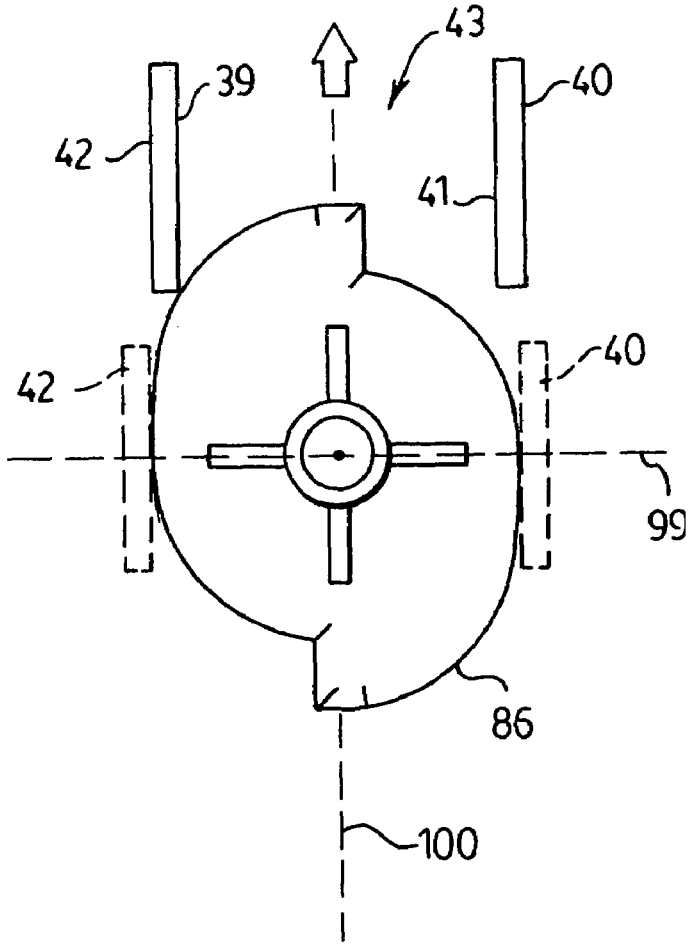
FIG. 10 is a view similar to FIG. 9 in the plane of section line 9–9' in FIG. 2 but showing the piston engagement flange as it is slid rearwardly in insertion and first engages the catch assembly.

As best seen in FIG. 1, the catch assembly 34 includes a stop shoulder member 36 having a tabular surface 38 which is oriented towards the chamber 16 when the reservoir 12 is inserted. A pair of substantially parallel spaced metal fingers 40, 42 extend from the tabular surface 38 towards the chamber 16, the fingers 40, 42 substantially defining the lateral extent of a cavity or horizontal slotway 43 therebetween. Each finger 40, 42 comprises a flattened ribbon of metal, formed so that a first endmost portion 44, 46 of each respective finger 40, 42 which is remote from the stop shoulder member 36 is resiliently deformable from an unbiased position, wherein the fingers 40, 42 assume their substantially parallel configuration to a biased position, wherein the endmost portions 44, 46 are moved apart. As seen in FIG. 2, the fingers 40, 42 extend parallel the axis 79. The slotway 43, best seen in FIGS. 1 and 10, extends normal to axis 79 about a central slotway centreline 100 shown in FIG. 10 which is radial to axis 79. Referring to FIG. 10, each finger 40, 42 has interior side surfaces generally indicated 39, 41 in FIG. 10 directed into the slotway 43 on each side thereof towards the interior side surface of the other finger so as to define the slotway therebetween. Each finger 40, 42 also has an edge side surface 124, 126 bordering an entranceway to the slotway 43 and extending away from the entranceway.

As shown in FIG. 2, finger endmost portion 44 includes an integrally formed projecting tab 48 and finger endmost portion 46 including integrally formed projecting tab 50. The tabs 48, 50 are generally located along each respective finger 40, 42, an equal distance from the tabular surface 38. Each of the tabs 48, 50 projects inwardly into the slotway 43 towards the other, extending angularly downward from the associated fingers 40, 42 towards the tabular surface 38. In this manner, tab 48 extends from endmost portion 44 so as to define thereon a leading side 52*a* which forms an obtuse angle with a remainder of the finger 40 and a trailing lowermost edge 52*b*. Similarly, tab 50 extends from endmost portion 46 so as to define thereon a leading side 54*a* which forms an obtuse angle with a remainder of finger 42 and trailing lowermost edge 54*b*.

In the embodiment shown, a second endmost portion 56, 58 of each respective finger 40, 42 is secured to the shoulder member 36 as, for example, by snap fitting in complimentary slots 56', 56" and 58', 58" formed therethrough. A generally U-shaped passage 60 is formed through the shoulder member 36 between second endmost portions 56 and 58. Passage 60 is adapted to permit the exit tube 83 of the piston 78 to slide horizontally therein on insertion or removal of the reservoir 12. As shown in FIG. 1, the passage 60 extends from a side 62 of shoulder member 36, a distance into the tabular surface 38.

A generally U-shaped web 66 is provided extending across the cavity 28. The U-shaped web 66 is positioned to permit the reservoir 12 to be slid horizontally inward into the housing 14 for insertion in the manner illustrated in FIG. 1. The web 66 is located such that when the reservoir 12 is slid into the housing 14, the web 66 abuts and supports the wall 17 of fluid chamber 16 to assist in maintaining the reservoir 12 in fluid dispensing position. Web 66 also engages a shoulder 23 of the valve assembly 22 such that the web 66 is sandwiched between the wall 17 and the valve assembly 22, thereby preventing axial sliding movement of the reservoir 12 as the dispenser 10 is used. The U-shape of the web 66 further advantageously assists in guiding the reservoir 12 as it is slidably inserted into and removed from the housing 14.

Two parallel spaced locating rods 64*a*, 64*b* are secured at a first end to the web 66. At a second end, each locating rod 64*a*, 64*b* extends through respective openings 68*a*, 68*b* formed through the shoulder member 36. A retaining ferrule 70*a*, 70*b* secured about the second end of each rod 64*a*, 64*b* respectively prevents the complete withdrawal of the locating rods 64*a*, 64*b* from the shoulder member 36. In this manner, the catch assembly 34 is guided in sliding movement along the rods 64*a*, 64*b*, between the first rest position shown in FIG. 2, wherein the shoulder member 36 abuts against ferrules 70*a*, 70*b*, and the second fully inserted position wherein the shoulder member 36 and fingers 40, 42 are moved along rods 64*a*, 64*b* a distance towards the web 66.

Springs 72*a*, 72*b* are provided about each of the locating rods 64*a*, 64*b* respectively. The springs 72*a*, 72*b* are sized to engage both the web 66 and the shoulder member 36 to resiliently bias the catch assembly 34 to the first rest position shown in FIG. 2. As is to be appreciated, pivotal movement of the lever 32 in the direction of the arrow 6 shown in FIG. 1 moves the end portion thereof against the shoulder member 36 to overcome the force of the springs 72*a*, 72*b*, moving the catch assembly 34 from the extended position to the retracted position. On release of the lever 32, the force of the springs 72*a*, 72*b* returns the catch assembly 34 to the extended position.

Figure 6:
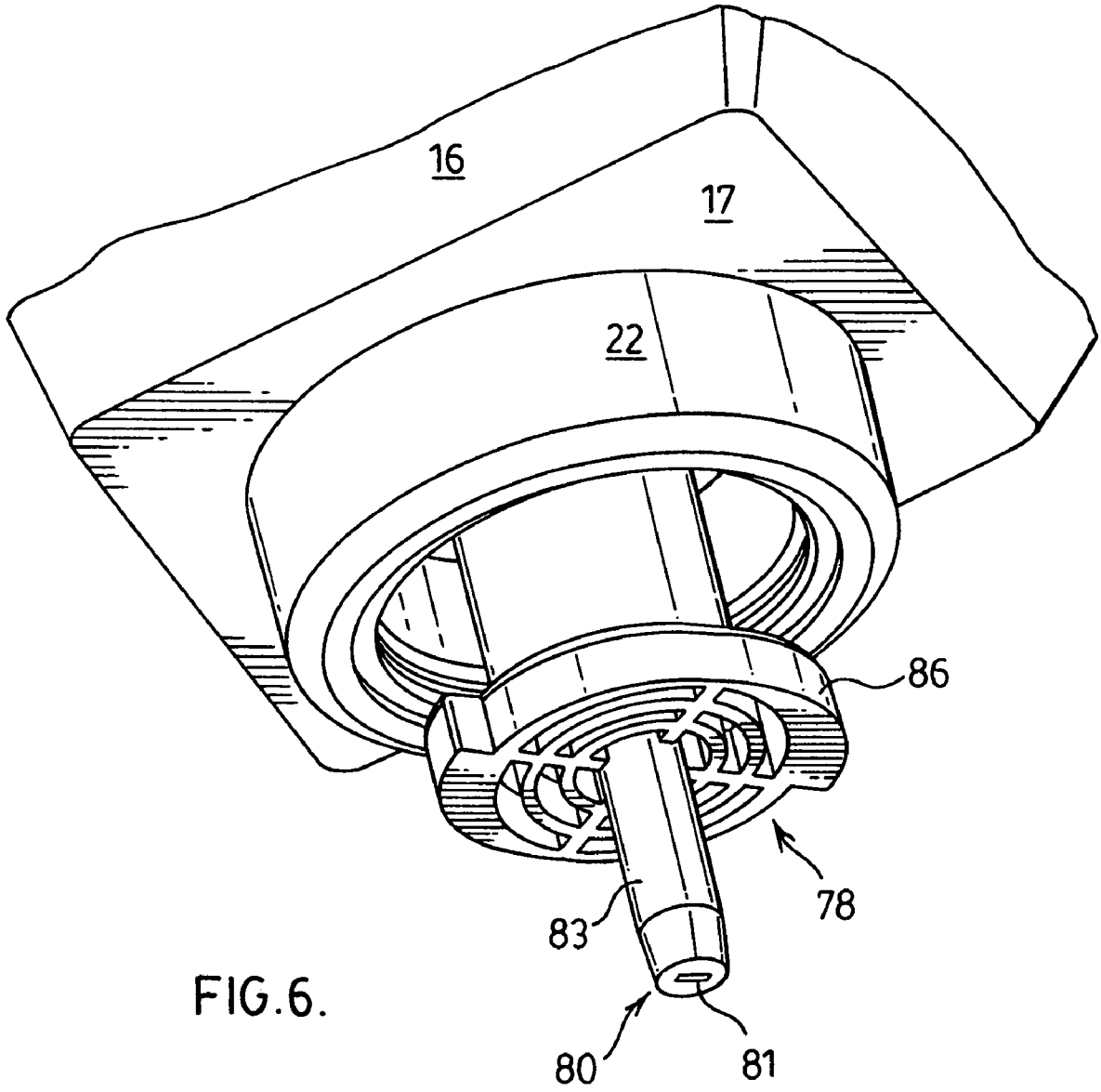
FIG. 6 is a pictorial view showing the reservoir of FIG. 1 with its valve assembly and piston extending from the reservoir.

FIGS. 2 and 3 show the reservoir valve assembly 22 as comprising a dispensing chamber 74 having at an inwardmost end thereof, a one-way valve 76 which permits fluid 18 to flow outwardly only from the chamber 16 into the dispensing chamber 74. The reciprocally movable piston element 78 is slidably received within the dispensing chamber 74 along axis 79 and rotatable relative the dispensing chamber 74 about the axis 79. Reciprocal movement of the piston element 78 causes fluid 18 to flow from the chamber 16 outwardly past the one-way valve 76 and via passage 82 inside exit tube 83 to exit out a nozzle 81 at an outermost end 80 of the piston element 78. The nozzle 81 restricts flow so as to develop a pressure drop across the nozzle 81 which creates a spray. The nozzle 81 is only schematically shown in cross-section in FIG. 2 and will, preferably, have a known construction for providing a spray. As best seen in FIG. 6, the nozzle 81 has an exit opening which is an elongate rectangle and will direct a frustoconical spray which is wide as measured in a direction of the longer side of the rectangle and relatively narrow as measured in a direction of the shorter side of the rectangle. The nozzle 81 is fixedly secured to the piston element 78 against relative rotation. The nozzle sprays the fluid being dispensed, preferably as an atomized spray, in a predetermined spray pattern orientated relative the axis 79 depending upon the relative rotational position of the piston element 78. The spray pattern may comprise a preferred frustoconical pattern as, for example, in a cone of rectangular cross-section to prevent the spray as, for example, being directed rearwardly onto the wall on which back plate 26 of the dispenser is supported by having the rectangle of the nozzle 81 disposed with the longer side of its rectangle disposed to be parallel to the wall. When the piston element 78 is in desired rotational positions relative the axis 79, the nozzle 81 directs fluid over desired angular sectors relative the housing and when the piston element 78 is in undesired rotational positions relative the axis 99, the nozzle directs fluid over undesired angular sectors relative the housing.

The piston element 78 is rotatable relative the dispensing chamber 74 about the axis 79 and, preferably, is to be placed in the desired rotational position in which the nozzle 81 directs its spray over a preferred sector relative the axis 79. The piston element 78 carries a radially extending flange 86 which provides engagement surfaces by which the piston element 78 is engaged by the actuator assembly 30 and actuated in reciprocal sliding movement to dispense fluid 18.

Figure 7:
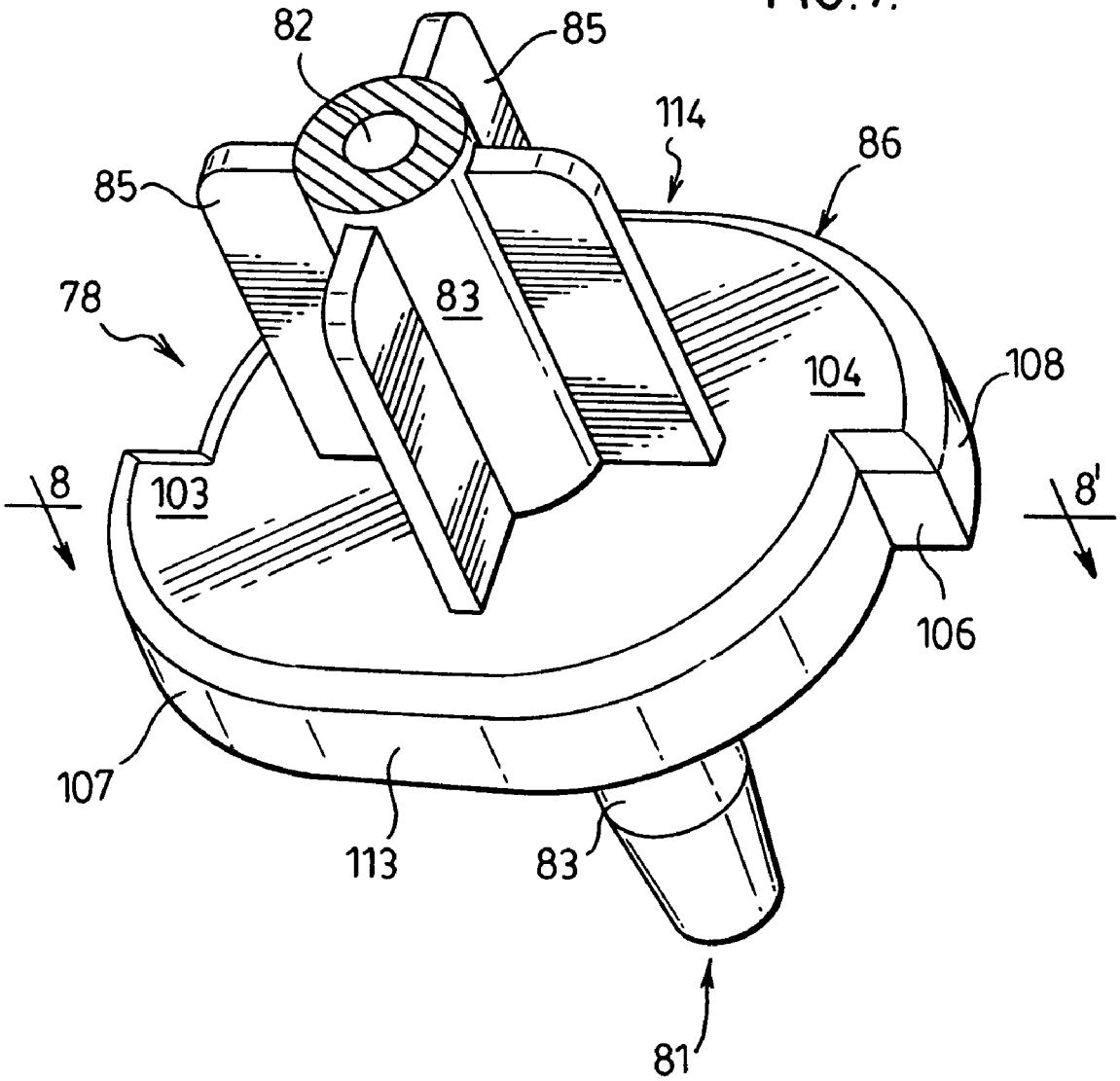
FIG. 7 is a pictorial view of the piston shown in FIG. 2 but cross-sectioned at section line 7–7' in FIG. 2.

As best seen in FIG. 7, the piston element 78 carries four guide vanes 85 which extend radially outwardly from the exit tube 83 on an inner side of the flange 86. The guide flanges 85 assist in coaxially locating the piston element 78 in the dispensing chamber 74 and in permitting relative rotation of the piston element 78 coaxially within the chamber 74.

The flange 86 is configured so as to interact with the actuator assembly 30 and have the piston element 78 assume the desired rotational position. In this regard, the actuator assembly 30 includes the catch assembly 34 carrying the pair of spaced resilient metal fingers 40 and 42 which are to receive the flange 86 therebetween.

Figure 8:
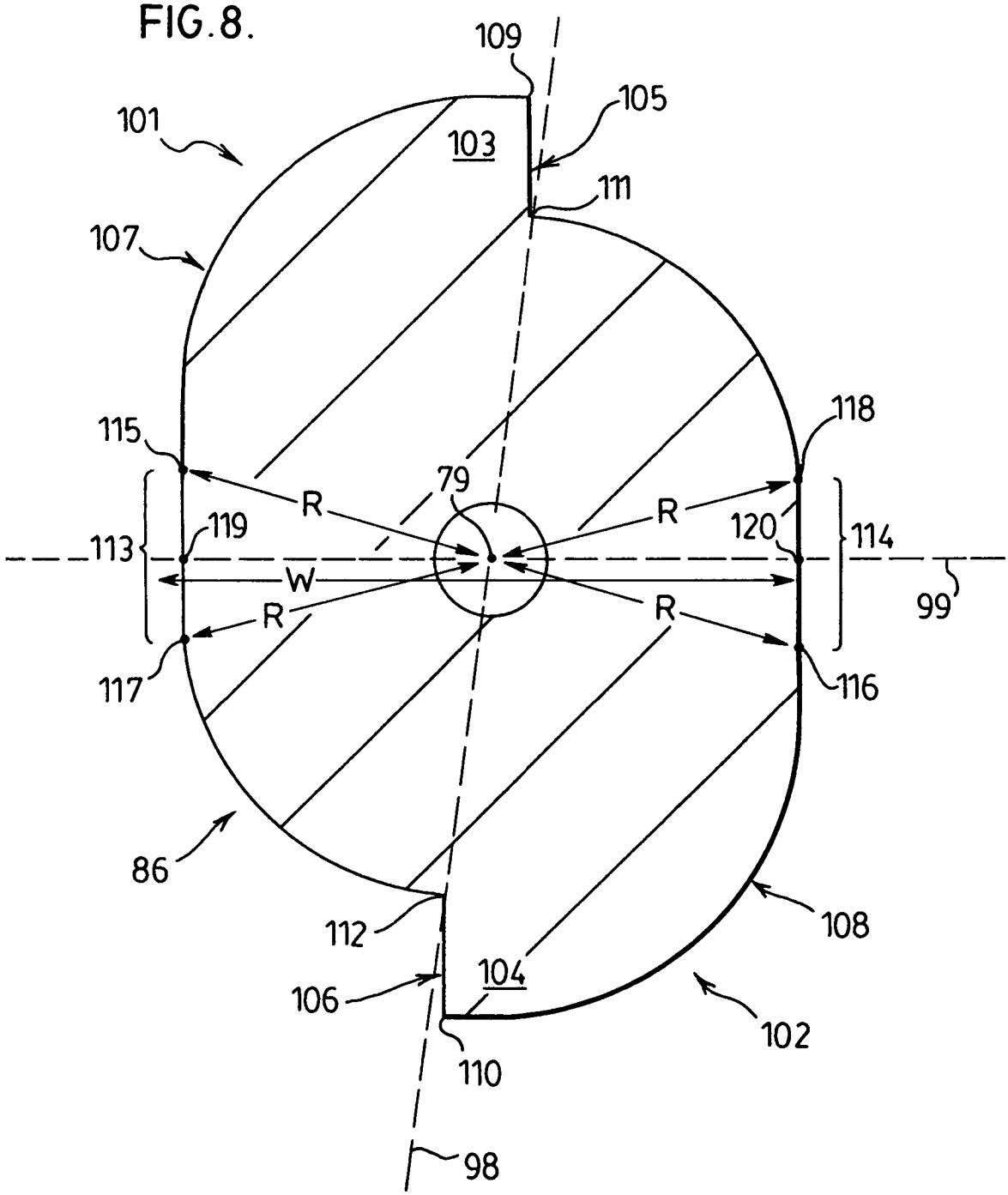
FIG. 8 is a cross-sectional plan view of merely the piston along section line 8–8' in FIG. 7.

Reference is made to FIGS. 7 and 8 which best show the preferred configuration of the flange 86. FIG. 8 is limited to showing the piston 78 pictorially as cross-sectioned along section line 8–8' in FIG. 7. FIG. 7 best shows the exit tube 83 carrying the passageway 82 and the four vanes 85 about the exit tube 83 which serve to assist in locating the piston 78 coaxial to the axis in the cylindrical dispensing chamber 74.

The flange 86 is configured such that it can be divided into halves about any plane through the axis 79 normal to the axis 79 with each half to be identical to the other but rotated 180° from each other. To state this in other terms, the external profile of the flange 86 repeats itself every 180° of rotation about axis 79.

FIG. 8 shows one such plane indicated as dotted line 98 normal axis 79 and through axis 79 which divides the flange 86 into a first left half 101 and a second right half 102.

Each half 101, 102 has an arm-like protrusion 103, 104 presenting a planar shoulder surface 105, 106 such that the shoulder surface 105, 106 is each directed in the same clockwise rotational direction. A back surface 107, 108 of each half 101, 102 joins an outer edge 109, 110 of its shoulder surface 105, 106 with an inner edge 112, 111 of the shoulder surface 106, 105 of the other half 102, 101.

Each back surface 107, 108, preferably, has a flat planar middle segment 113, 114 such that the middle segments 113 and 114 are diametrically opposite from each other and each centered relative the axis 79 about a diametric plane indicated by dashed line 99 as parallel surfaces spaced a width W. Each middle flat segment 113, 114 have outer edges 115, 116 and inner edges 117, 118. Each edge 115, 116, 117 and 118 of the flat segments 113, 114 is located at a radius R from the axis 79.

The back surfaces 107, 108 curve from outer edge 109, 110 of the shoulder surfaces 105, 106 to the outer edge 115, 116 of the middle flat segments 113, 114 with the radius of the curve not less than the radius R and preferably greatest nearer the outer edges 109, 110 of the shoulder surfaces 105, 106 and reducing to become R at the outer edges 115, 116 of the middle flat segments. Similarly, the back surfaces 107, 108 curve from inner edges 112, 111 of the shoulder surfaces 106, 105 to the inner edges 117, 118 of the middle flat segments 113, 114 with the radius of the curve not less than the radius R and preferably greater nearer the inner edges 112, 111 of the shoulder surfaces and reducing to become R at the inner edges 117, 118 of the middle flat segments 113, 114.

The diametric width of the flange 86 is the width measured in any line passing through the axis 79. The diametric width is the smallest from point 119 to point 120 on diametric plane 99 where it equals W.

The diametric width increases as the point at which the diametric width is measured moves from the diametric plane 99 toward either outer edge 109, 110 of the shoulder surfaces. As a result, when the flange 86 is received between the fingers 40, 42 and biases the fingers apart, the bias of the fingers to move towards each other will have a camming effect which tends to rotate the flange 86 to a position in which the fingers 40, 42 are spaced the least distance apart, that is, engaging on the flat middle segments 113, 114.

The flange is advantageously sized having a radial dimension larger than the remainder of the piston element 78 so as to engage an endmost surface 75 of the dispensing chamber 74 to limit its inward sliding movement therein.

On insertion and replacement of the reservoir 12, the cover 24 is moved to the open position shown in FIG. 1. The reservoir 12 is aligned horizontally forward of the reservoir cavity 28 with the outlet 20 upward and the axis 79 orientated at a desired predetermined angulation relative the vertical, in the case of FIG. 1, vertical. In such angulation, the reservoir 12 is slid horizontally rearwardly relative to the housing 14, into the housing 14 such that the wall 17 of the reservoir is positioned abutting the U-shaped web 66, with the web 66 sandwiched between part of the lower wall 17 and a shoulder 23 of the valve assembly 22. As the reservoir 12 is slid horizontally rearwardly into the housing 14, the flange 86 slides radially into a slotway 83 defined intermediate the resilient fingers 40, 42. The flange 86 biases the fingers 40, 42 apart and the outermost end 80 of the piston element 78 moves into the U-shaped fluid passage 60. The reservoir 12 is preferably adapted to be slid into the housing linearly normal the axis 79, however, the reservoir could slide at a different angle than normal or along a non-linear or arcuate path.

The interaction of the flange 86 with the fingers 40, 42 will vary depending upon the relative rotational position of the piston element 78 and the relative axial position of the piston element 78. A new replacement reservoir preferably carries the piston element 78 in the fully retracted position such that, on insertion, the piston element 78 slides horizontally to assume a relative position, referred to later as the third orientation, to the actuator assembly 30 and its fingers 40, 42 as seen in FIG. 5.

Rotation

Rotation of the piston element 78 on horizontal sliding insertion of the reservoir is now discussed with reference to FIGS. 9 to 16 which are intended to show the piston element in the preferred third orientation axially relative the housing during horizontal sliding insertion.

Figure 9:
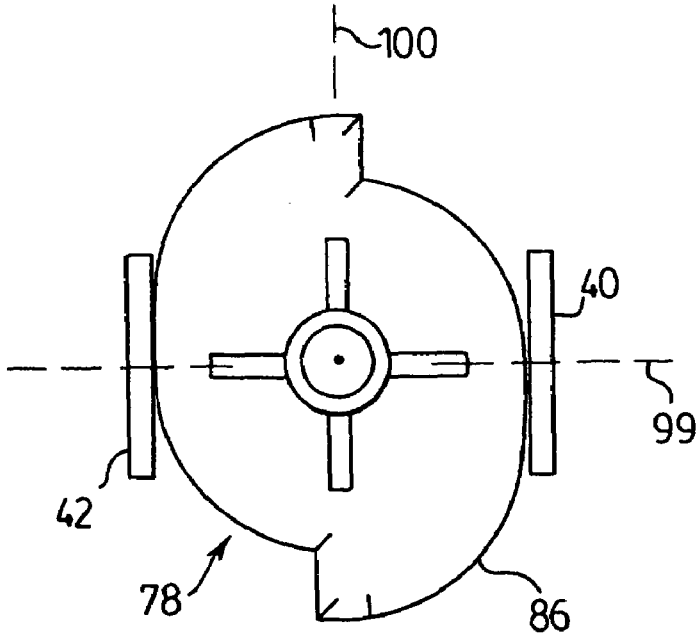
FIG. 9 is a partial cross-sectional view of the piston engagement flange and the catch assembly taken in horizontal plane 9–9' of FIG. 5 with the piston element in a desired rotational position.

FIG. 9 is a partial cross-sectional view along section line 9–9' in FIG. 5 showing the piston element 78 as fully inserted horizontally between the fingers 40, 42 and with the piston element 78 in a desired rotational position with the diametric line 99 normal to the a vertical medial line 100 of the slotway 43 defined between the fingers 40, 42.

In FIG. 9, the fingers 40, 42 engage on and are each centered on the flat middle segments 113, 114 of the flange 86.

Reference is made to FIG. 10 which is similar to FIG. 9 but shows the relative positioning of the piston element 78 at the entranceway to the slotway 43 forward of the fingers 40, 42 and ready to be moved horizontally rearwardly during insertion with the axis 79 to advance along the medial plane 100 of the slotway 43 in the direction of the arrow to assume the position of FIG. 9. In FIG. 10, the fingers 40, 42 are in unbiased positions spaced a distance which is less than W. On sliding the piston element 78 rearwardly, the curved surface of the flange 84 engages on the finger 42 and later on finger 40 to bias the fingers 40, 42 away from each other to the relative position shown in FIG. 9. The relative position of the fingers 40, 42 on the flange 84 in FIG. 9 is shown in dashed lines in FIG. 10.

In such horizontal insertion, as shown in FIG. 10, there is substantially no tendency of the piston element 78 to rotate relative the fingers 40, 42 from the desired rotational position with the diametric line 99 normal the slotway medial plane 100. The piston element 78, at all times in insertion from the position of FIG. 10 to the position of FIG. 9, is in a desired rotational position relative the axis 79 and the housing with the diametric line normal the medial line 100 of the slotway 43.

Figure 11:
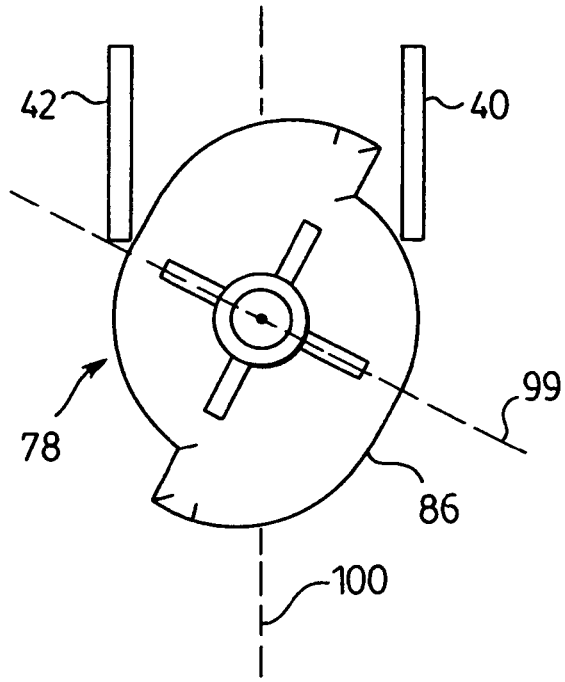
FIGS. 11, 12 and 13 are each views similar to FIG. 9 in the plane of section line 9–9' in FIG. 2 but showing successive relative positions of the piston engagement flange as it is slid rearwardly in insertion from the positions of FIG. 11 to FIG. 12 to FIG. 13.
Figure 12:
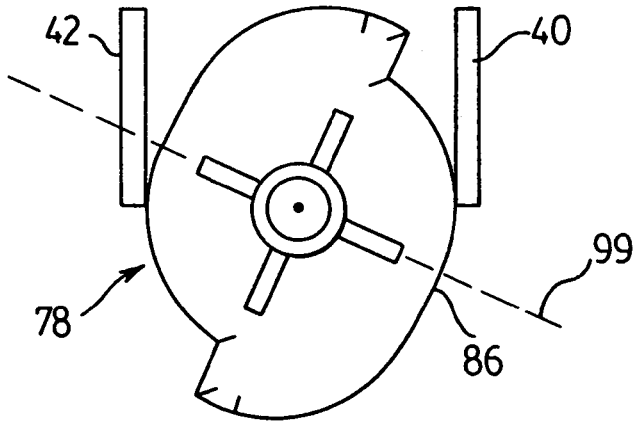
Figure 13:
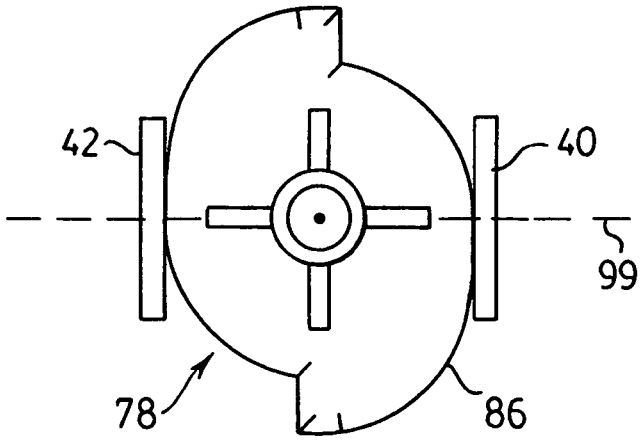

Reference is made to FIGS. 11, 12 and 13.

FIG. 11 is similar to FIG. 10 but with the piston element 78 in an undesired rotational position relative the housing about the axis 79 being rotated 45° clockwise relative the position in FIG. 10 and, in this position, is slid forwardly so that the flange 86 enters the entranceway to the slotway 43 and first contacts one of the fingers 40, 42.

FIG. 12 illustrates relative positioning of the flanges 86 and fingers 40, 42 after the piston element 78 has been slid horizontally rearwardly from the position of FIG. 11 showing that the flange 86 has forced the fingers 40, 42 apart.

FIG. 13 illustrates a position similar to FIG. 9, to which the piston element 78 moves on further horizontal rearward sliding from the position of FIG. 12. With rearward movement of the reservoir 12 with the piston element 78 free to rotate relative the reservoir 12, the bias of the fingers 40, 42 will tend to rotate the flange 86 counterclockwise from a position with the fingers 40, 42 more widely spread in FIG. 12 to the position with the fingers 40, 42 less widely spread in FIG. 13. In the progression of insertion, the piston element 78 is rotated from the undesired rotational position of FIG. 11 to the desired rotational position of FIG. 13 with the diametric line 99 normal the medial line 100.

Figure 14:
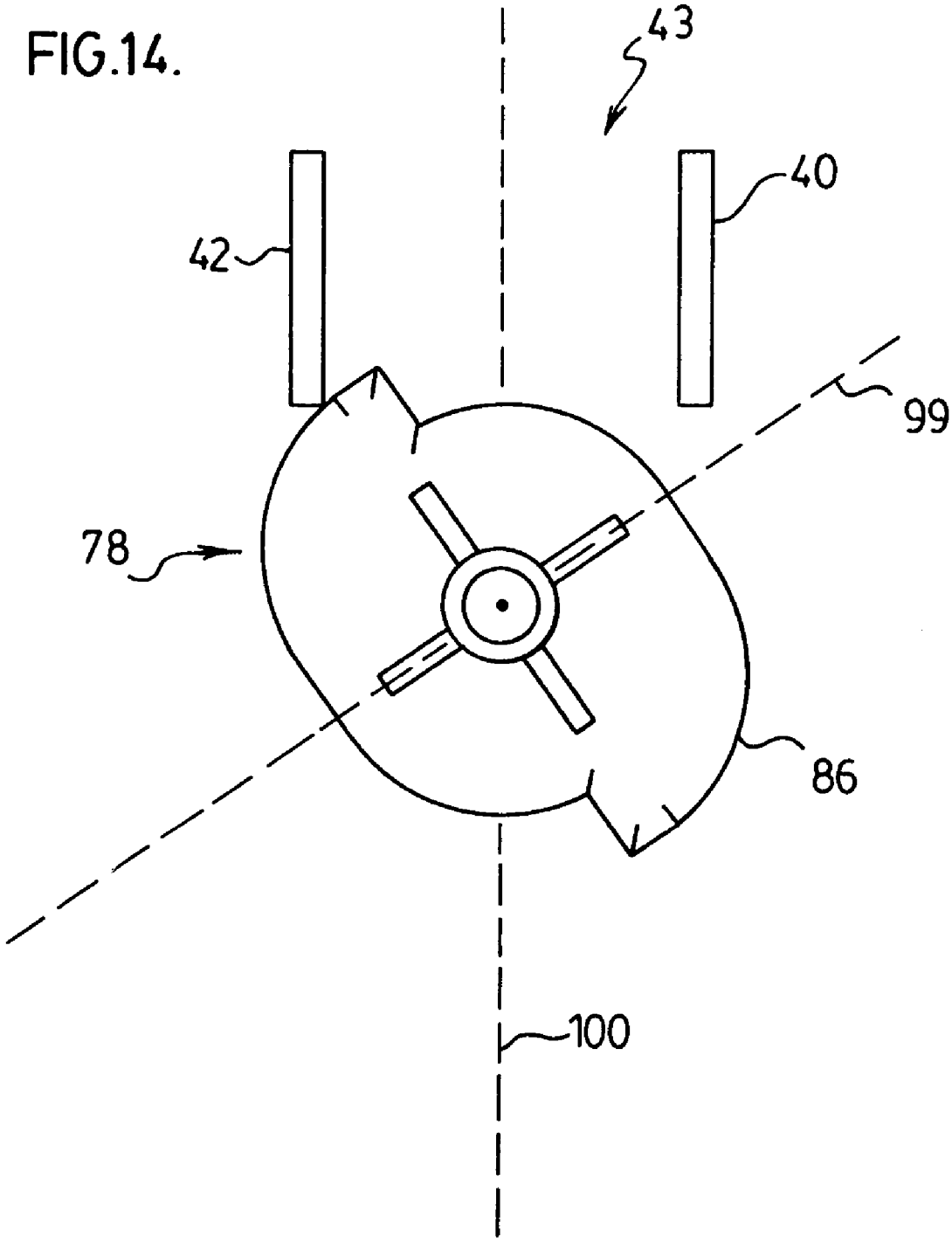
FIG. 14 is a view similar to FIG. 9 in the plane of section line 9–9' in FIG. 2 but showing the piston engagement flange as it is slid rearwardly in insertion and first engages the catch assembly.

FIG. 14 is similar to FIG. 10 but with the piston element 78 in the undesired rotational position about axis 79 relative the housing rotated 45° counterclockwise relative the position in FIG. 10 and in that position slid forwardly that the flange 86 first contacts one of the fingers 40, 42. With further movement forwardly, the flange 86 will move the fingers 40, 42 outwardly and the bias of the fingers 40, 42 will tend to rotate the piston element clockwise towards the desired position shown in FIG. 9.

Figure 15:
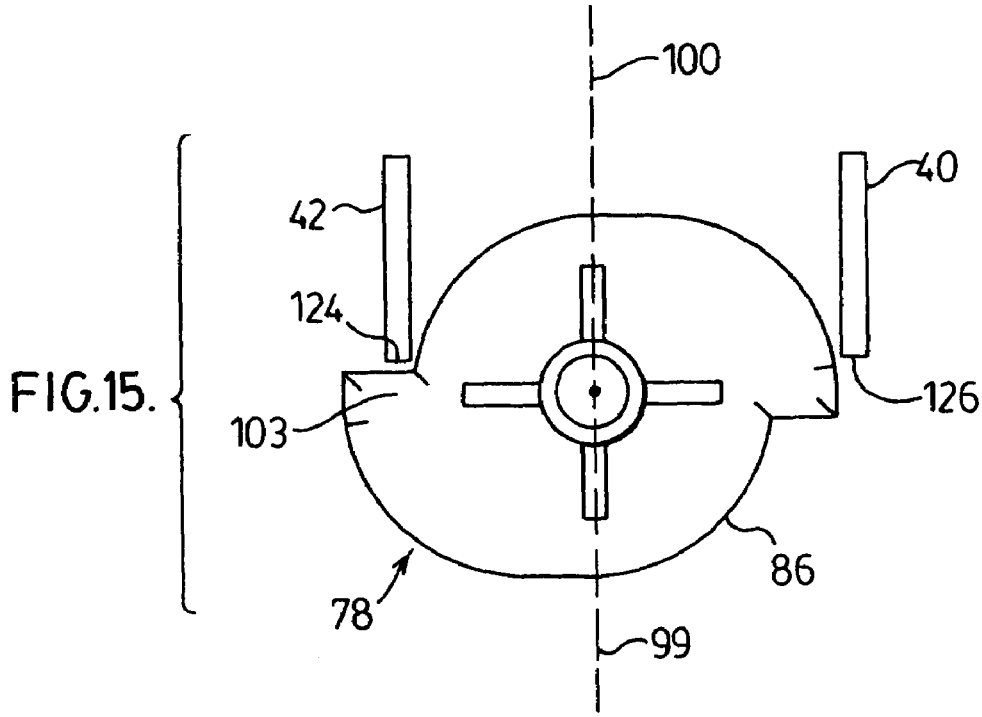
FIGS. 15 and 16 are each views similar to FIG. 9 in the plane of section line 9–9' in FIG. 2 but showing successive relative positions of the piston engagement flange as it is slid rearwardly in insertion from the position of FIG. 15 to that of FIG. 16.
Figure 16:
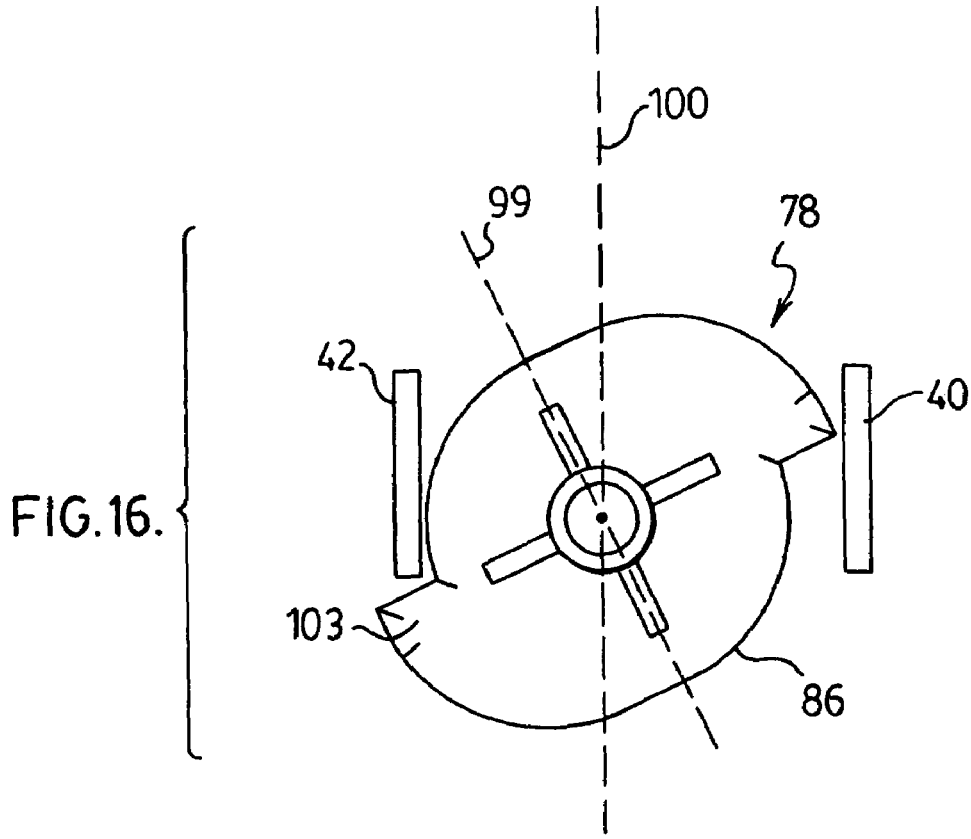

FIG. 15 is similar to FIG. 10 but with the piston element 78 in the undesired angular orientation relative the axis rotated relative the position in FIG. 10, either clockwise or counterclockwise, and in a position that the left hand side shoulder, shoulder 103, as seen in FIG. 15, engages a forwardly directed surface 124 of the left-hand side finger 42. With further forward sliding of the piston element 78, the piston element 78 rotates by reason of the surface 124 preventing forward movement of the shoulder 103. With further forward sliding to the position shown in FIG. 16 of the piston element 78, the engagement of the surface 124 with the shoulder 103 and the bias of the spread apart fingers 40, 42 tend to rotate the piston element counterclockwise to the desired position of FIG. 9.

In FIG. 10, the two fingers 40 and 42 are shown in an unbiased position in which they are spaced a distance indicated W. The slotway 43 is defined between the fingers 40 and 42 which slotway 43 extends in a direction indicated by slotway medial plane 100.

Axial

When the reservoir 12 inserted in the housing 14, the radially extending flange 86 will assume one of three axially displaced orientations shown best in FIGS. 2, 4 and 5.

In a first axial orientation shown in FIG. 2, the catch assembly 34 and the piston element 78 are coupled to each other with the radially extending flange 86 fully in a first zone 88 (shown for clarity in FIG. 3). The first zone 88 is the area of the slotway 43 between the fingers 40, 42 that is delineated at an upper extent by the trailing edges 52*b*, 54*b* of each respective tab 48, 50 and at a lower extent by the tabular surface 38.

In the first axial orientation, the movement of the actuator assembly 30 moves the radially extending flange 86 therewith. As is to be appreciated, the housing 14 and reservoir 12 are preferably configured so that when the actuator assembly 30 is in the extended position and is coupled to the radially extending flange 86, the piston element 78 is in an optimum extended position relative to the dispensing chamber 74.

To dispense fluid 18, the actuator assembly 30 is cycled by the pivotal movement of the lever 32 moving the catch assembly 34 from the extended position to the retracted position shown in FIG. 3, and then the springs 72 returning the catch assembly 34 back to the extended position. As the shoulder member 36 moves from the extended position to the retracted position, the tabular surface 38 engages the lower flange surface 92. As best seen in FIG. 3, the engagement of the tabular surface 38 with the lower flange surface 92, slides the piston element 78 inward in a first direction relative to the dispensing chamber 74. The piston element 78 moves inward into the dispensing chamber 74 until the upper flange surface 94 abuttingly engages the endmost surface 75 to limit further movement of both the piston element 78 and actuator assembly 30.

On release of the lever 32, the catch assembly 34 is returned to the extended position under the force of springs 72*a*, 72*b* to complete the cycle. As is to be appreciated, on return movement of the catch assembly 36 under the force of springs 72*a*, 72*b*, the trailing edge 52*b*, 54*b* of each tab 48, 50 moves into engagement with the upper flange surface 94, to slide the piston element 78 in a second direction outward from the dispensing chamber 74.

The reservoir 12 may also be inserted into the housing 14 with the piston element 78 in a second or third axial orientation. In the second axial orientation seen in FIG. 4, the catch assembly 34 and piston element 78 are uncoupled with the radially extending flange 86 partially in the first zone 88 and partially in a second zone 90. As best seen in FIG. 5, the second zone 90 is generally the area of the slot 43 delineated at a lower extent by the leading sides 52*a*, 54*a* of each tab 48, 50 and at an upper extent by the endmost surface 75 of dispensing chamber 74.

In the third axial orientation shown best in FIG. 5, the catch assembly 34 and piston element 78 are uncoupled with the radially extending flange 86 fully in the second zone 90.

If on sliding insertion of the reservoir 12 into the housing 14 the radially extending flange 86 assumes either the second or third uncoupled axial orientation, on first cycling of the actuator assembly 30, the catch assembly 34 moves relative to the flange 86 to achieve the first coupled axial orientation.

With the engagement flange 86 in the uncoupled axial orientation, either wholly or partially in the second zone 90 as shown in FIG. 4 or 5, the initial movement of the catch assembly 34 from the first position moves the leading side 52*a*, 54*a* of each of tab 48 and tab 50 into contact with the lower flange surface 92. As the fingers 40, 42 move towards the web 66, the leading sides 52*a* and 54*a* act as camming surfaces, deflecting the endmost portions 44 and 46 of each associated finger 40 and 42 from the unbiased position, radially outwardly to the biased position. As is to be appreciated, the end portions 44, 46 are deflected a sufficient distance to permit movement of projecting tabs 48 and 50 axially past the radially extending flange 86.

Once the tabs 48, 50 move relative to the piston element 78 so that each respective trailing edge 52*b*, 54*b* is positioned between the upper flange surface 94 and the chamber 16, the resiliency of the fingers 40, 42 causes the return of endmost portions 44, 46 to the unbiased position. On the return to the unbiased position, the trailing edges 52*b*, 54*b* are moved to a position to overlap and abuttingly engage a peripheral portion of the flange surface 94. The engagement of the trailing edge 52*b*, 54*b* with the flange surface 94 prevents return axial movement of the radially extending flange 86 past the projecting tabs 48,50 effectively coupling the flange 86 to the catch assembly 34 between the tabs 48,50 and the tabular surface 38.

The spacing between the tabs 48, 50 and tabular surface 38, is selected to permit the insertion of the radially extending flange 86, fully within first zone 88. The tabular surface 38 and fluid passage 60 are further selected such that when the radially extending flange 86 is in the first, coupled axial orientation with the catch assembly 34, a portion of the tabular surface 38 abuts a portion of the lower flange surface 92.

Rotation/Axial

New replacement reservoirs preferably carry the piston element 78 in the fully retracted position and, when inserted, assume the third axial orientation. With first cycling of the piston element 78, the piston element 78 is moved relative the fingers 40, 42 to the first, coupled axial orientation with deflection and changes in the extent the fingers 40, 42 are biased apart. Such change of the position of the fingers 40, 42 causes relative movement between the fingers 40, 42 and flange 66 which increases the tendency of the piston element 78 to rotate toward the desired angular orientation shown in FIG. 9.

The dispenser 10 of the present invention, advantageously permits insertion of the reservoir 12 into the housing without the requirement of ensuring the piston element 78 is in a particular axial or rotational position relative the catch assembly 30.

As is to be appreciated, with the radially extending flange 86 in the first coupled axial orientation, cycling of the actuator assembly 30 causes the axial inward and outward movement of the piston element 78 in the dispensing chamber 74 to dispense fluids 18. On activation of the dispenser 10, fluid 18 flows from the chamber 16 outwardly through the passage 82 to the nozzle 81. Once the supply of fluid 18, in the chamber 16 is exhausted, the reservoir 12 may be removed for replacement by again moving the cover 24 to the open configuration shown in FIG. 1, and radially sliding the reservoir 12 outwardly in a direction transverse to the direction of axial movement in the reverse manner as insertion.

Although not essential, providing a passage 60 having a U-shape and extending into a side 62 of the shoulder member 36 is advantageous as it simplifies insertion of the reservoir 12 into the housing 14. Specifically, the engagement of the outermost end 80 of the piston element 78 against the edge of the fluid passage 60 may be advantageously used to assist in guiding placement of the reservoir 12 in the correct axial alignment in the actuator assembly 30.

Reference is made to FIGS. 17 to 22 which illustrate a second embodiment of a dispenser in accordance with the present invention. The dispenser of FIGS. 17 to 22 operates in a very similar manner to that described with reference to FIGS. 1 to 16, however, with the reservoir 12 adapted to be moved vertically down into the housing 10 and then moved, while in a vertical position, rearwardly. The reservoir 12 carries a valve assembly 22 with a piston element 78 identical to that described with reference to FIGS. 1 to 16.

Figure 19:
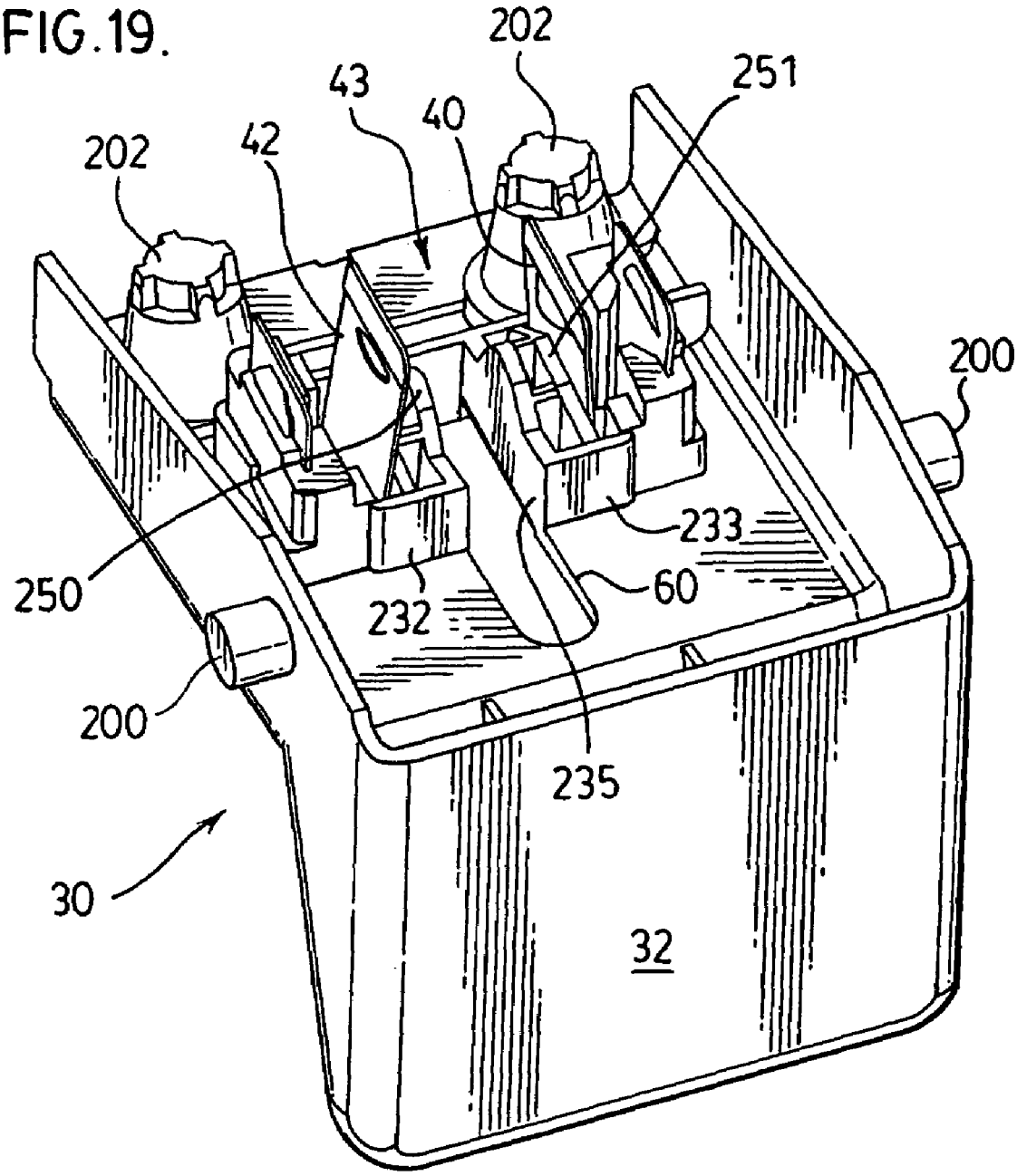
FIG. 19 is a pictorial view of the actuator assembly of the dispenser of FIG. 17.

The actuator assembly 30, as best seen in FIG. 19, is adapted for pivoting relative to the housing 10 on stub axles 200 biased downwardly by springs (not shown) to be engaged on spring stubs 202 with an upper end of the springs to engage on the underside of the web 66 provided in the housing. The actuator assembly 30 has a hand lever 32 adapted to be manually engaged by a user and urged towards a wall supporting the housing to dispense fluid.

As best seen in top view in FIG. 19, the actuator has metal fingers 40, 42 substantially identical to those in the embodiment of FIG. 1 defining a horizontal slotway 43 therebetween. A passage 60 is formed below the fingers between the fingers 40, 42 through which the exit tube 83 of the piston element 78 is to extend as seen in FIGS. 18 and 20 to 22.

Figure 17:
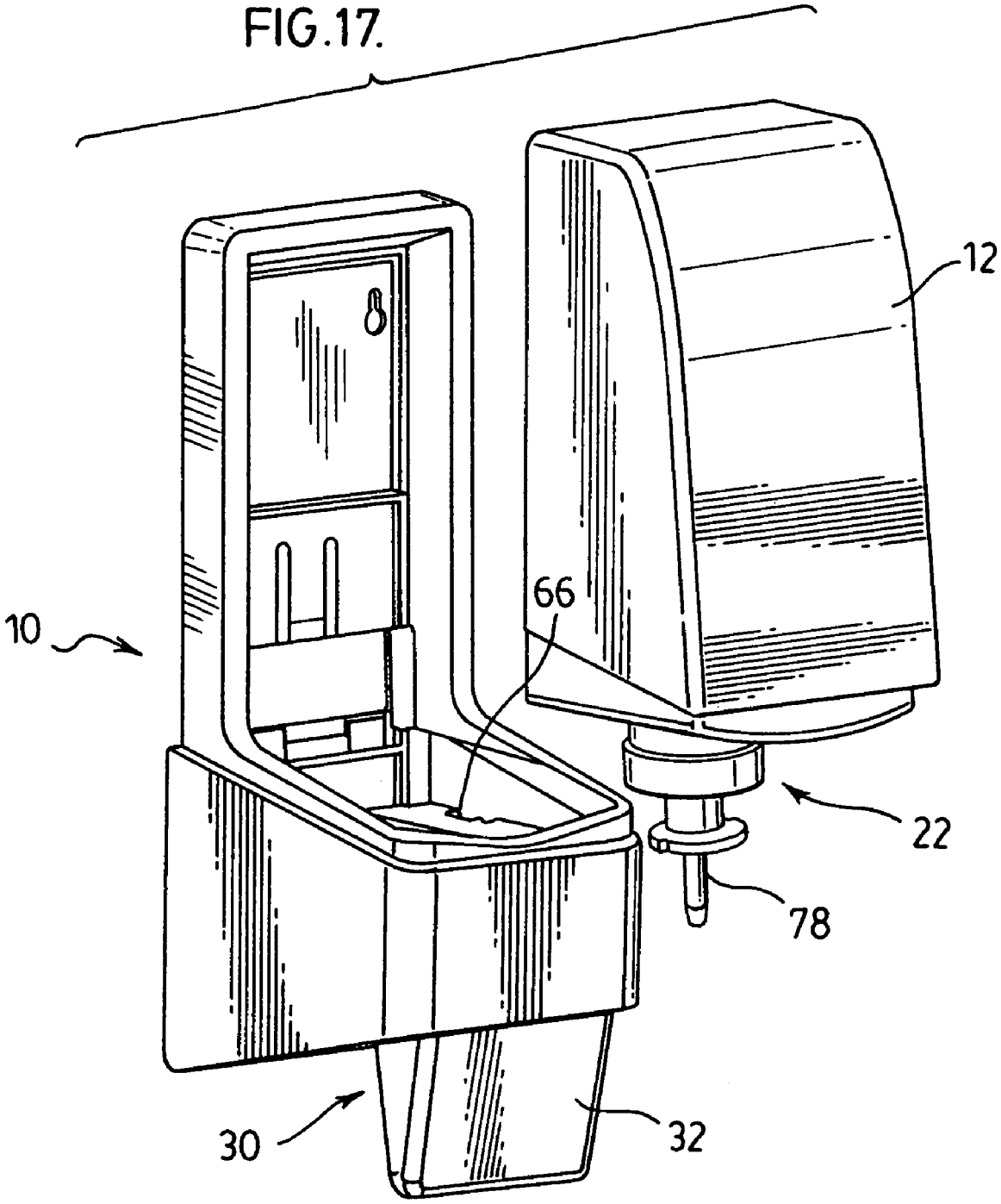
FIG. 17 is a partially exploded pictorial view of a second preferred embodiment of a housing and reservoir in accordance with the invention.

While only shown in FIG. 17, the housing 10 carries a web 66 substantially similar to the web 66 in FIG. 6 which is to receive the neck of the reservoir as between the wall 17 and the valve assembly 22.

Figure 18:
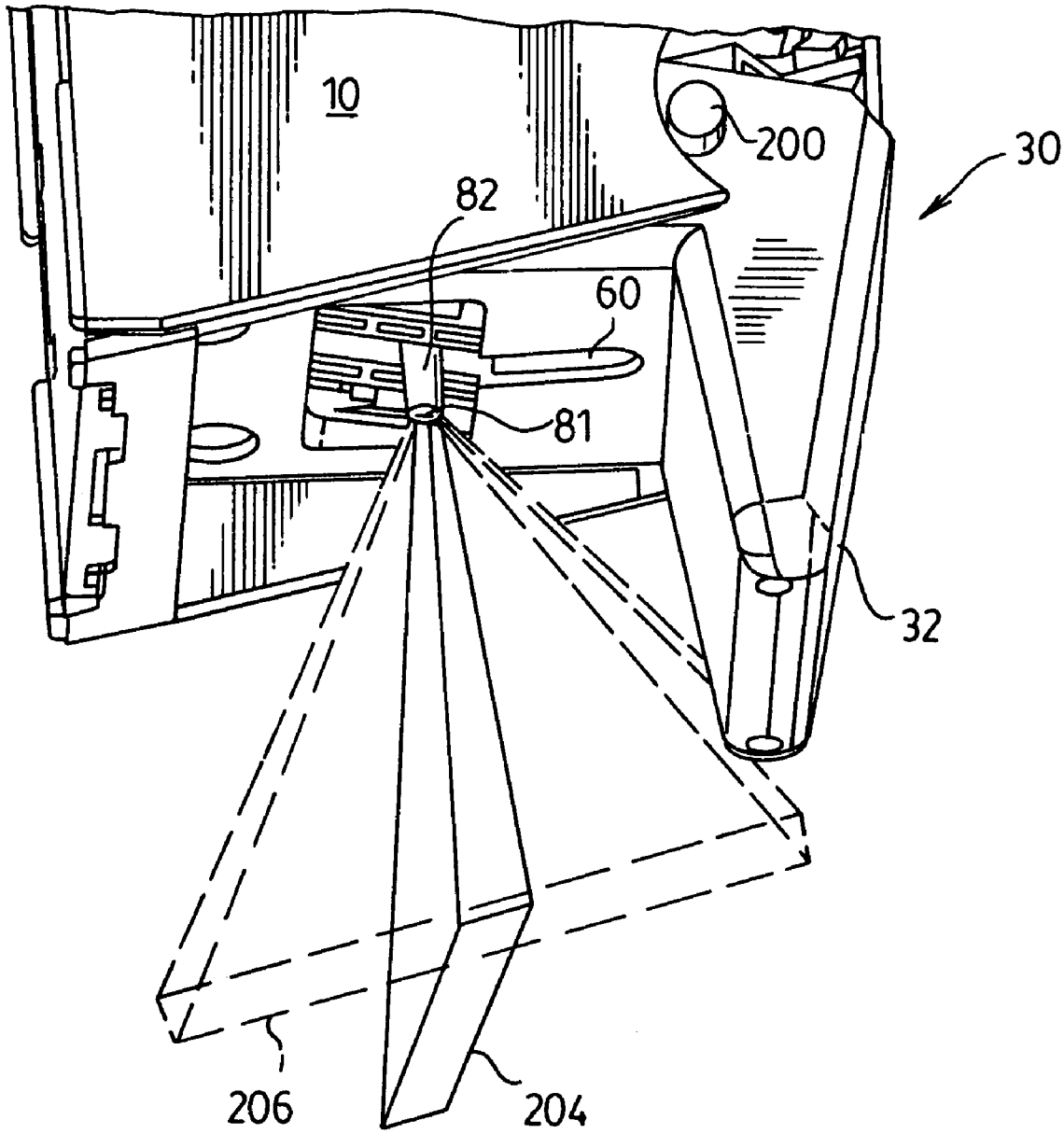
FIG. 18 is a schematic partial pictorial view of the dispenser of FIG. 17 showing spray patterns.

FIG. 18 illustrates as 204 the angular sector over which the nozzle 81 directs fluid when the piston element 78 is in a desired rotational position with a long side of a rectangle of the nozzle 81 parallel to the lever 32. FIG. 18 illustrates in broken lines the undesired angular sector 206 over which the nozzle 81 would direct fluid if the nozzle 21 is orientated in an undesired rotational position 90° from the desired rotational position shown in solid lines. As seen, the undesired angular sector 206 results in the spray impacting on the rear side of the lever 32 on its inward pivoting, as would be disadvantageous.

Figure 20:
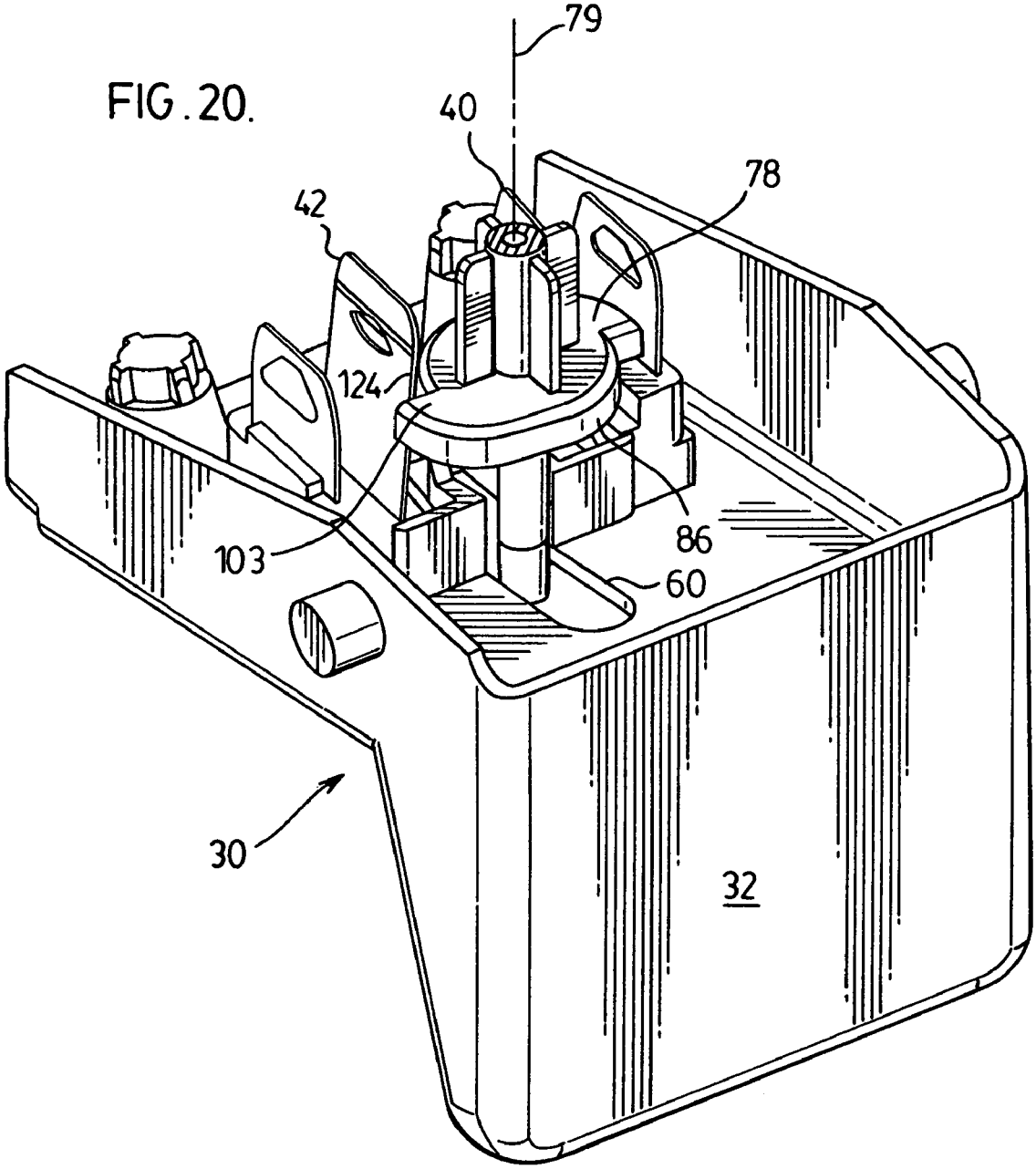
FIGS. 20, 21 and 22 are pictorial views of the actuator of FIG. 19 showing the piston element of the reservoir as being inserted and assuming positions similar to that illustrated in FIG. 15, FIG. 16, in FIGS. 20 and 21, respectively.
Figure 21:
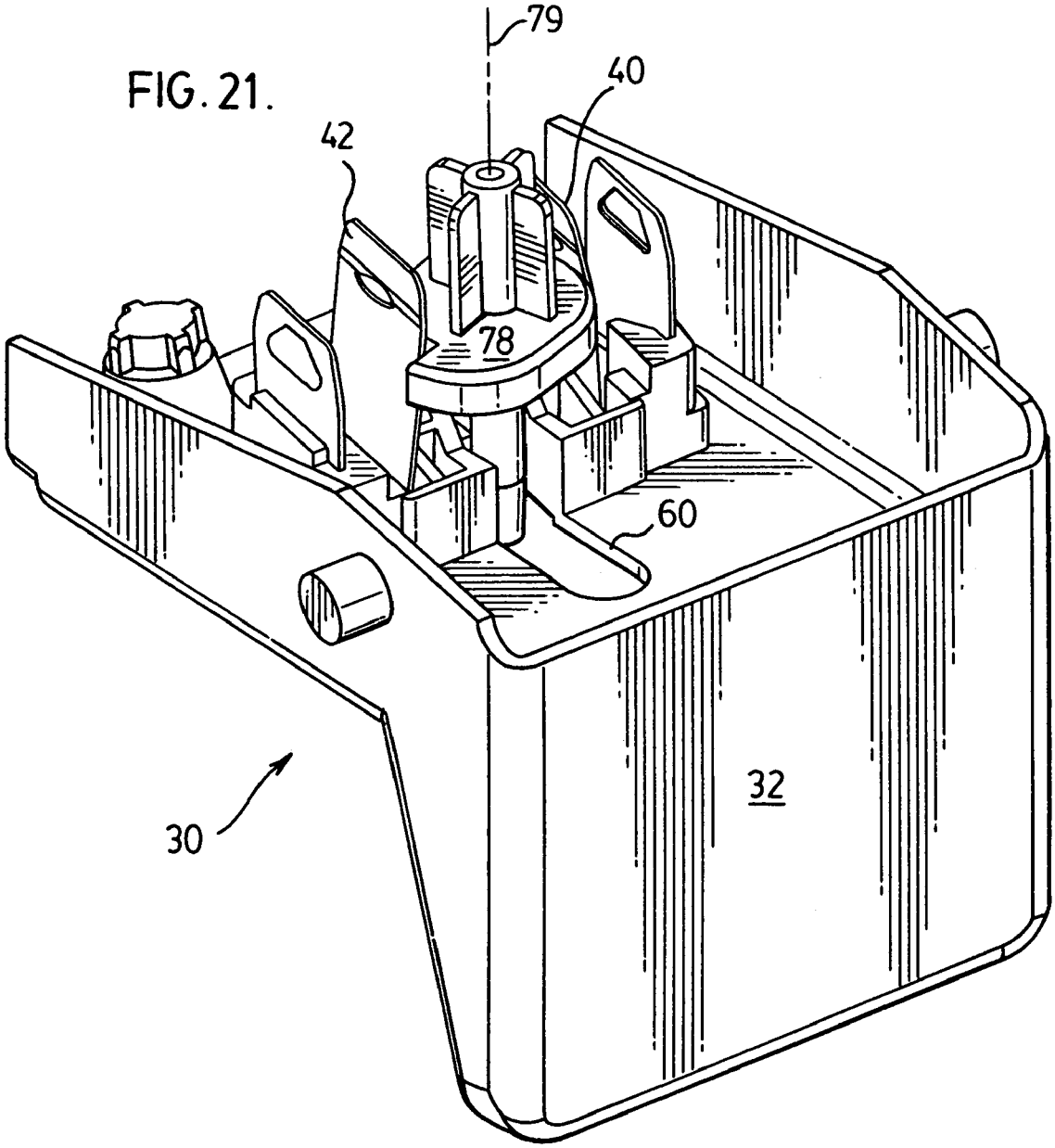
Figure 22:
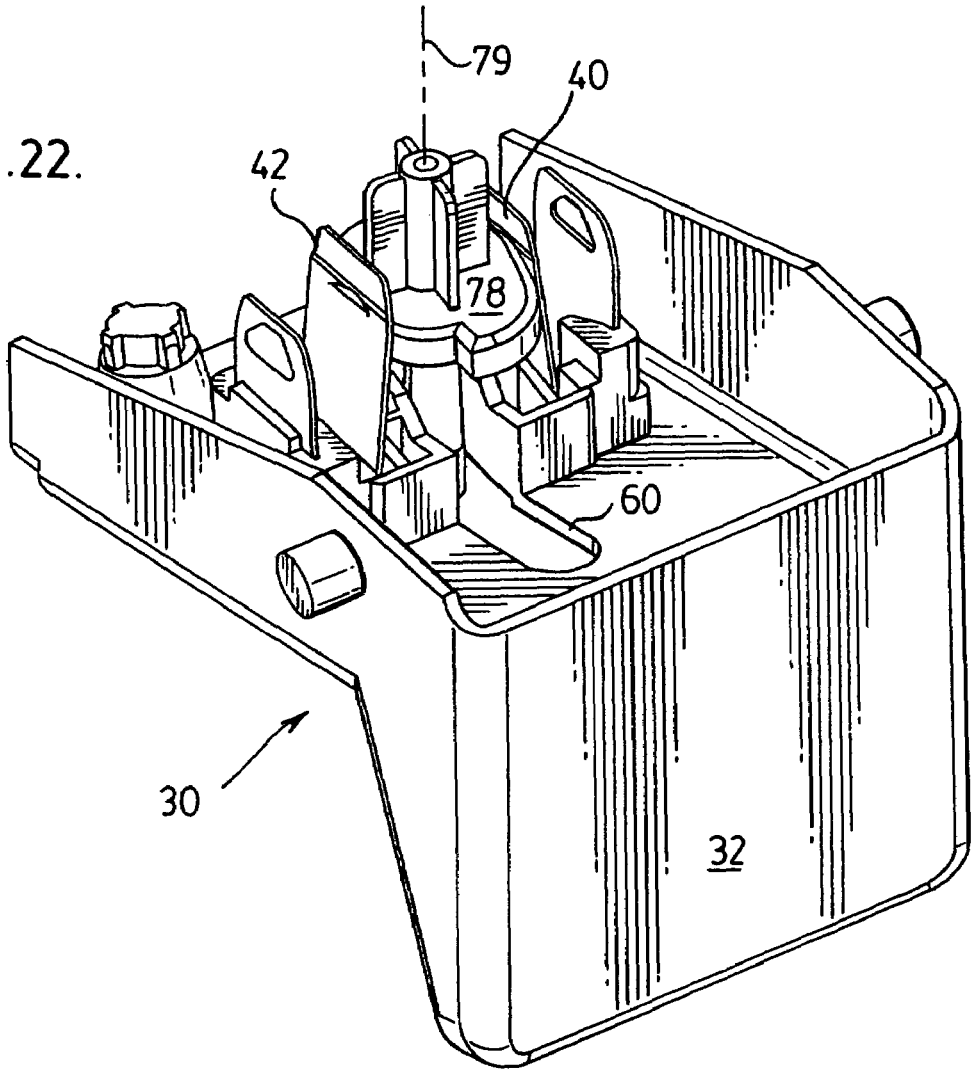

FIG. 20 illustrates in pictorial view with the second embodiment, the piston element 78 as being inserted and in the position substantially identical to that illustrated in FIG. 15 with the first embodiment. In insertion, the piston element 78 is being slid horizontally rearwardly and the shoulder 103 of the flange 86 becomes engaged with the forwardly directed surface 124 of the finger 42. From the position of FIG. 20, with further rearward sliding of the piston element 78, piston element 78 becomes rotated about its axis 79 and rotates counterclockwise in assuming the position of FIG. 21 which effectively corresponds to the position shown in FIG. 16 and, subsequently, towards the position shown in FIG. 22. From the position shown in FIG. 22, with further movement of the piston 78 as, for example, in axial movement of the piston, the bias of the fingers 40, 42 on the cam surfaces of the flange 86 will tend to rotate the piston element 78 to its desired angular position.

Figure 23:
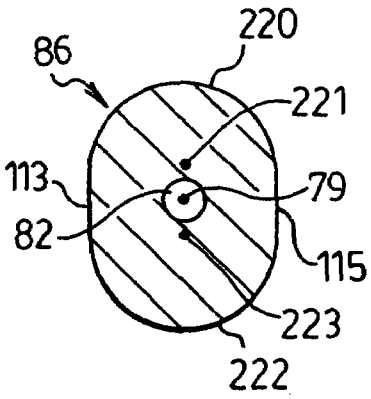
FIG. 23 is a cross-sectional view similar to FIG. 8 but of a piston element having a first modified flange.

Reference is made to FIG. 23 which shows a cross-sectional view through the flange 86 of an alternate piston element 78 showing a different configuration for the flange. The flange 86 in FIG. 23 is illustrated as being of a racetrack shape with parallel flat center portions 113 and 115 having at either end semi-circular portions 220 and 222 of a radius equal to the width between the flat portions 113 and 115 and each centered on axis 221 and 223 which are equally spaced from axis 79. The axis 79 of the piston element is shown as centered in the middle of the flat sections 113 and 115. The embodiment of FIG. 23, therefore, has similarities to the embodiment in FIG. 8, however, without the shoulder-forming arms 103 and 104 at each end.

Figure 24:
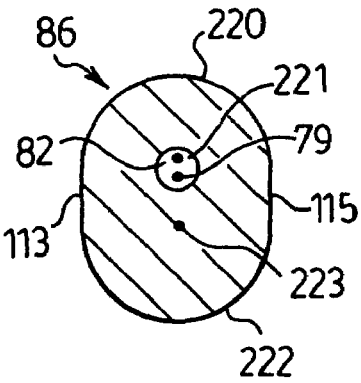
FIG. 24 is a cross-sectional view similar to FIG. 8 but of a piston element having a second modified flange.

Reference is made to FIG. 24 which illustrates a cross-sectional view of an alternate form of the flange 86 which has an exterior shape identical to that in FIG. 23, however, has the opening 82 and the axis 79 of the piston displaced towards one end that is closer to axis 221 than axis 223. In the embodiment of FIG. 24, having the axis 79 asymmetrically placed can be of assistance in initiating rotation as in the case where the piston element 78 is inserted 90° from the desired rotational orientation.

Figure 25:
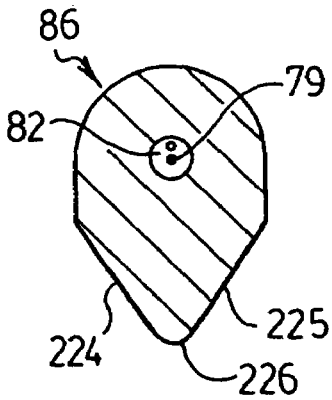
FIG. 25 is a cross-sectional view similar to FIG. 8 but of a piston element having a third modified flange.

Reference is made to FIG. 25 which is identical to the embodiment of FIG. 24, however, the lower semi-circular portion in FIG. 24 is replaced by a wedge-shaped portion with flat surfaces 224, 225 merging at apex 226.

With the embodiments illustrated in FIGS. 23 to 25, the forces of the fingers 40, 42 acting on the circumferential surfaces of the flange 86 will end to rotate the piston element to the desired rotational position.

In the embodiments illustrated in FIGS. 1 to 24, the camming interaction which is to rotate the piston element 78 to desired rotational orientation on insertion is a camming interaction between radially outwardly directed surfaces of the flange 86 and the fingers 40 and 42. This is not necessary and the camming action may be developed by the interaction of other surfaces.

Figure 26:
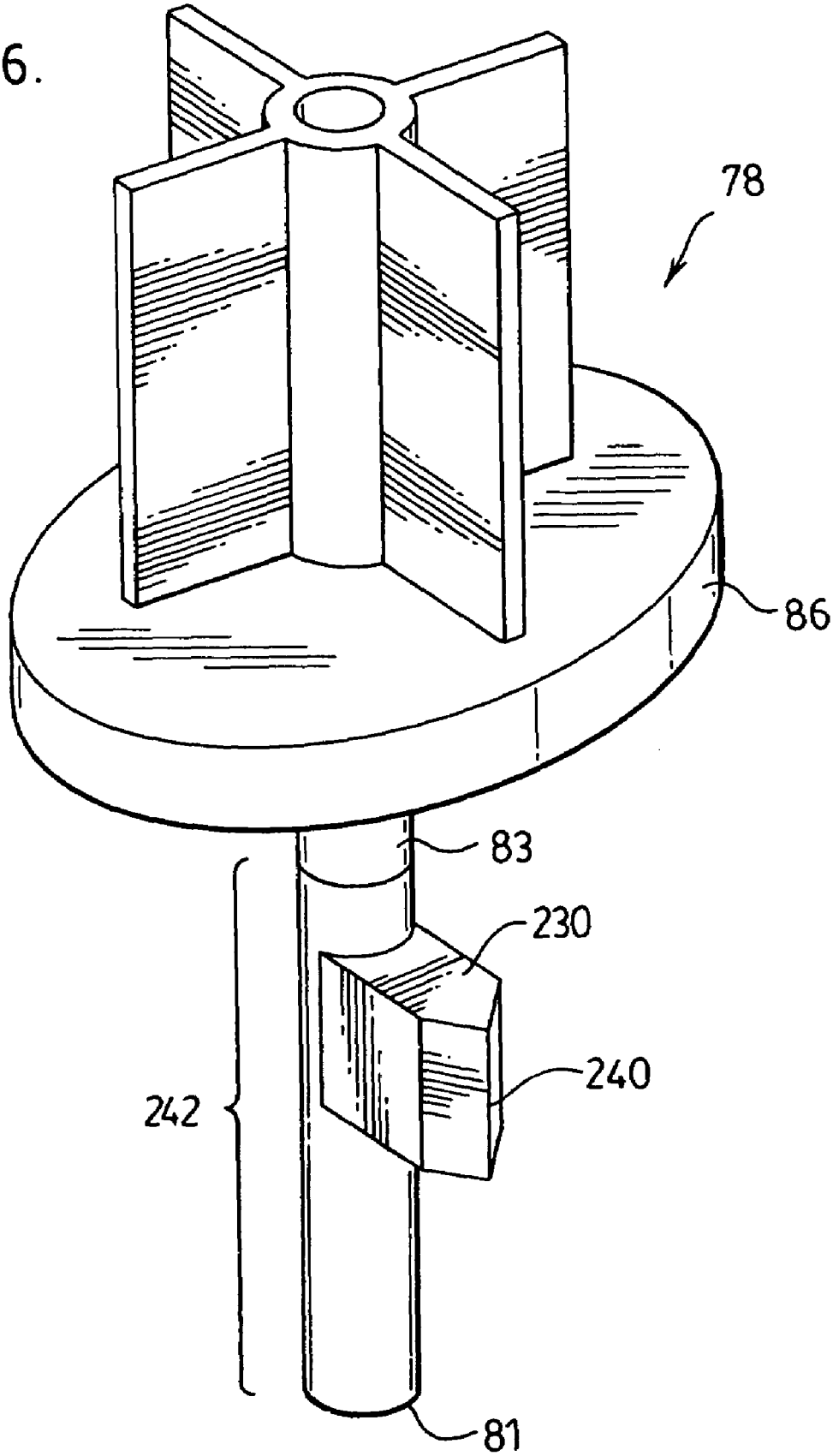
FIG. 26 is a pictorial view similar to FIG. 7 but of a modified piston element.

Reference is made to FIG. 26 which is a view of a piston element 78 similar to that in FIG. 7, however, illustrating a piston with a circular flange 86 and with a cam arm 230 fixedly secured to the exit tube 83.

Figure 27:
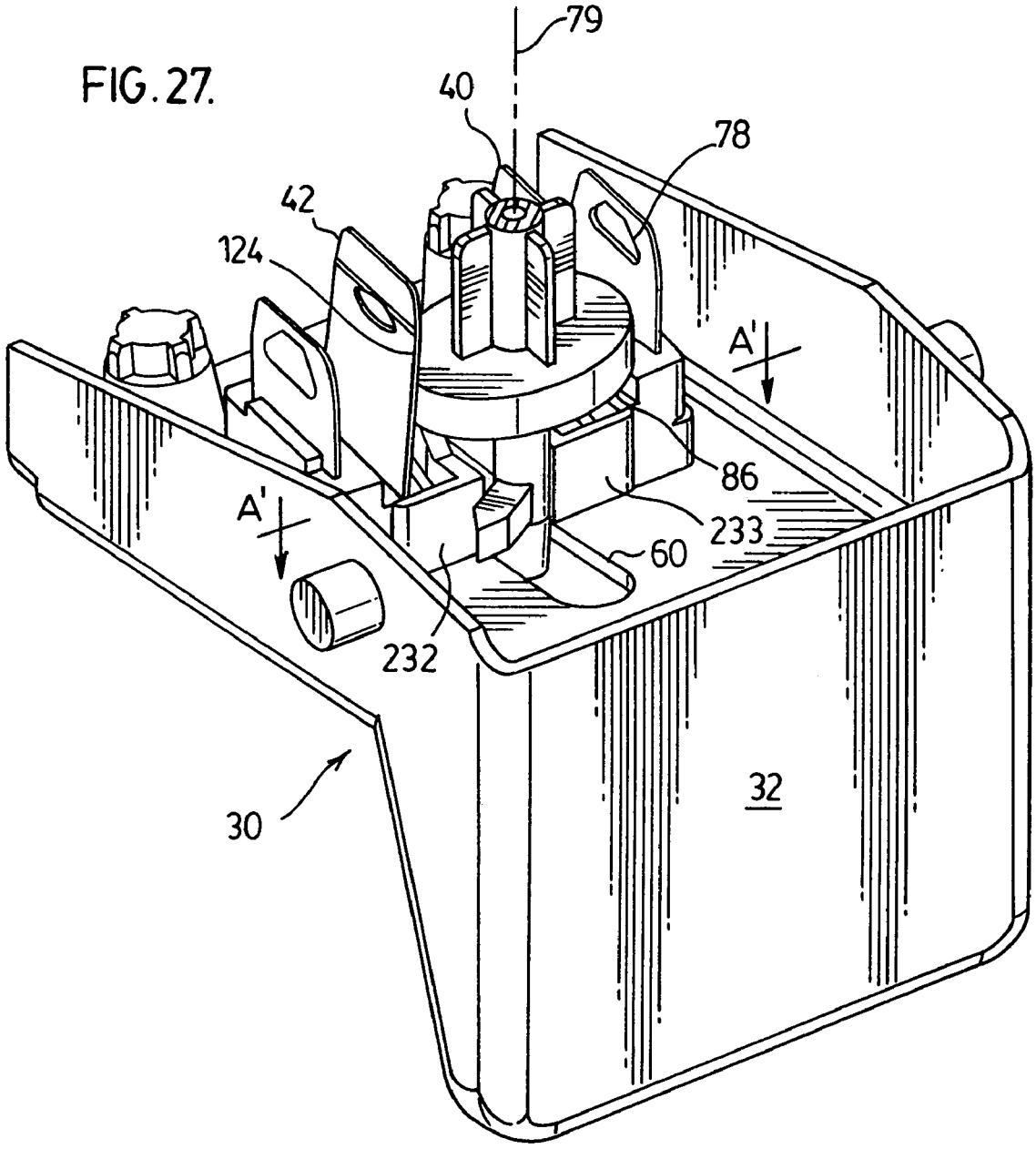
FIG. 27 is a pictorial view similar to FIG. 20 but with a piston element as shown in FIG. 26.

FIG. 27 is a pictorial view similar to FIG. 20 but showing the piston element 78 of FIG. 26 inserted with the piston element disposed rotated 45° from a preferred desired orientation. The piston element 78, on insertion, is disposed at a height such that the cam arm 230 engages one of two vertical, forwardly disposed exterior shoulder surfaces 232, 233 on each side of the passage 60. As is to be appreciated, with further rearward movement of the piston element 78, the cam arm 230 will engage one of the interior shoulder surfaces 232, 233 and will cam the piston element 78 to rotate towards the desired rotational position. Of course, with further inward movement of the piston element 78, the cam arm will come to engage interior shoulder surfaces 234, 235 of the passage 60 in FIGS. 28 and 19 defining the channel 60.

Figure 28:
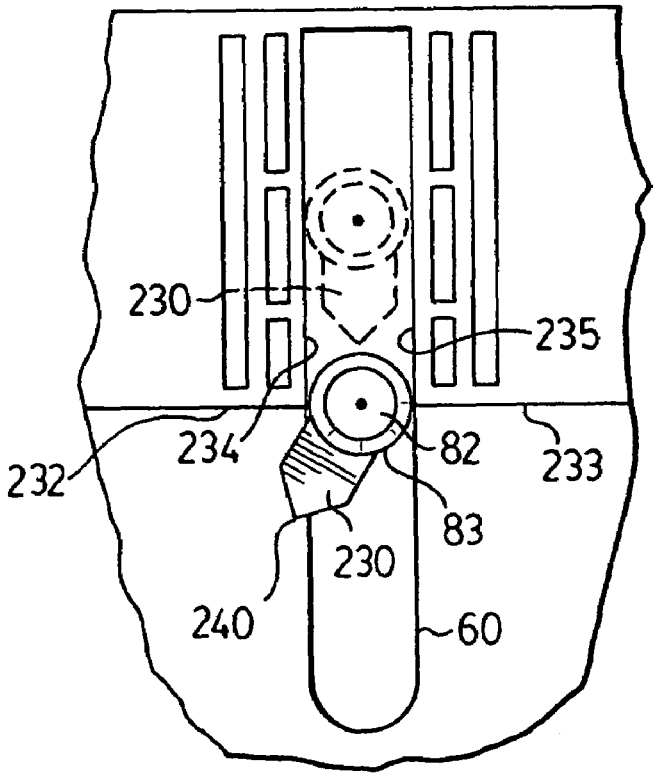
FIG. 28 is a partial cross-sectional view along section line A–A' in FIG. 27.

FIG. 28 illustrates a cross-sectional view through plane A–A' in FIG. 28 showing the piston element firstly in solid lines as in FIG. 27 with the cam arm 230 engaged on the exterior shoulder surface 232 and in dashed lines in a position which the exit tube 83 and cam arm 230 will adopt when slid horizontally rearwardly to be fully inserted and the nozzle 81 is in the desired rotational orientation. In the position shown in solid lines in FIG. 28, the cam arm 230 comes to engage the exterior shoulder surface 232 so as to cam the cam arm 230 to rotate to point forwardly.

Figure 29:
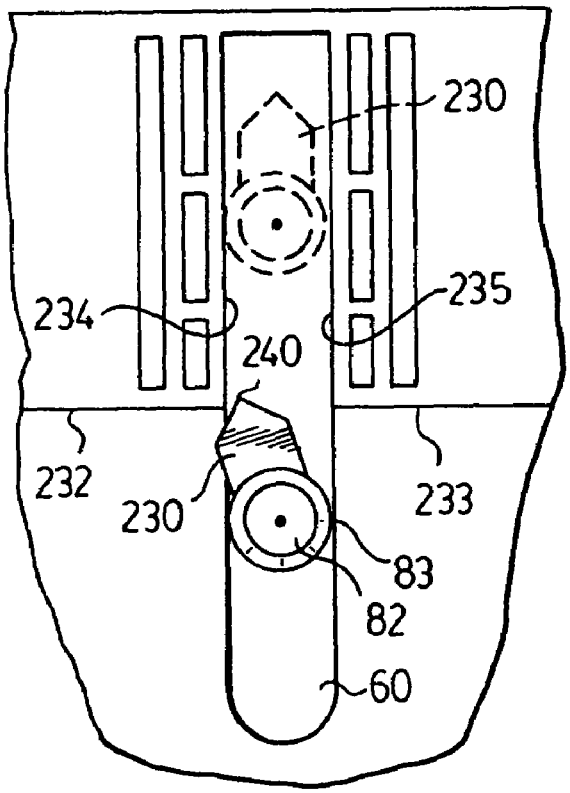
FIG. 29 is a partial cross-sectional view similar to FIG. 28 but with the piston element in a different position.

Reference is made to FIG. 29 which shows a cross-sectional view similar to that in FIG. 28 but with the piston element 78 in rotational position that the center point 240 and cam arm 230 initially engages between the interior shoulder surfaces 234 and 235 as shown in solid lines and with rearwardly movement comes to adopt the position shown in dashed lines with the cam arm 230 pointed rearwardly and with the nozzle 81 rotated to the desired angular orientation.

It is to be appreciated that when a center point 240 of the cam arm 230 is disposed to extend into the slot 60 between the interior shoulder surfaces 234 and 235, as in FIG. 29, then the piston element will become disposed with the cam arm pointing rearwardly. However, when the center point 240 of the cam arm 230 is disposed to engage the outer shoulder surfaces 232, 233 then, with insertion, in the final position, the cam arm 230 will come to extend forwardly from the piston element.

In the embodiments of FIGS. 26 to 28, the flange 26 may be circular and the interaction of the cam arm 230 alone may be relied for rotation. Alternatively, the flange 86 may be oval and have, for example, a suitable orientation as shown in either FIGS. 23, 24 or 25 and, in combination, the interaction of both the camming of the flange 86 and the cam arm can assist in relative rotation of the piston element 78.

In the context of the embodiment illustrated in FIGS. 26 to 28, the nozzle 21 and the cam arm 230 may be carried on an end portion 242 of the exit tube 83 with such end portion 242 journalled for rotation coaxially about the axis 79 relative to the remainder of the piston element 78. In this case, the piston element 78 may have a circular flange 86 and the end portion 242 of the exit tube 83 carrying the nozzle 82 and the cam arm 230 may independently be rotated to a desired position on insertion of the piston element. However, in another embodiment, the end portion 242 of the exit tube 83 carrying the nozzle may be fixed to the remainder of the piston element 78 such that there is required rotation of the entirety of the piston element 78 or at least the portion of the piston element comprising the flange 86 and the camming arm 81 and the nozzle 81 together in unison.

Figure 30:
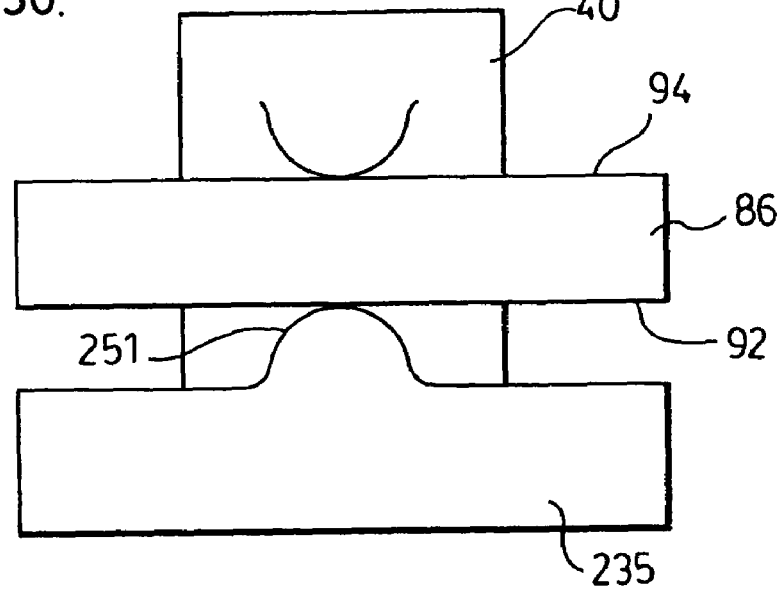
FIG. 30 is a partially cross-sectioned schematic view showing a flange of a piston element as in the embodiment of FIGS. 19 to 22.
Figure 31:
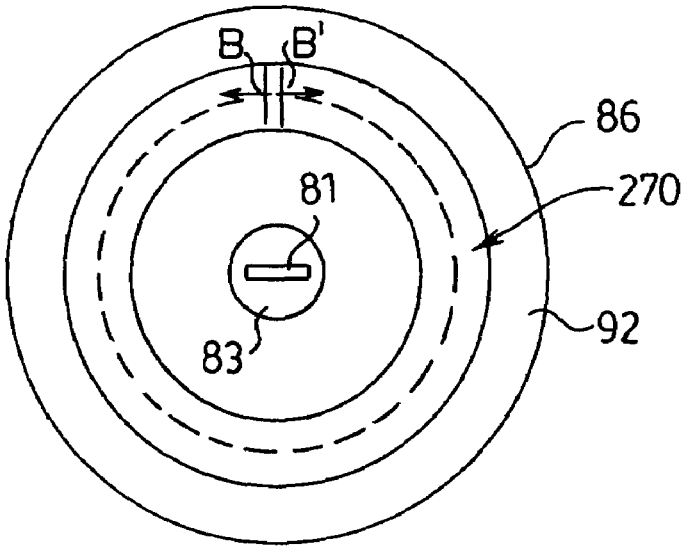
FIG. 31 is a bottom view of a modified flange of a piston element.

Reference is made to FIG. 19 which shows that upwardly directed arcuate camming surfaces 250, 251 are provided on either side of the channel 60 which arcuate surface 250 is adapted to engage the downwardly directed lower surface of the flange 86 of the piston element 78. FIG. 30 schematically illustrates a side view showing the interior shoulder surface 253 of the channel 60 and the finger 42 engaging a flange 86 in the first axial orientation wherein the flange 86 has planar upper and lower surfaces 92 and 94 as in FIGS. 3 and 7. FIG. 31 illustrates a bottom view of a further embodiment of a piston element 78 identical to that in FIGS. 3 and 7 with the exception of having a flange 86 which is cylindrical about the axis 79 and with carrying on the downwardly directed lower surface 92 of the flange 86 a raised annular camming ramp 370.

Figure 32:
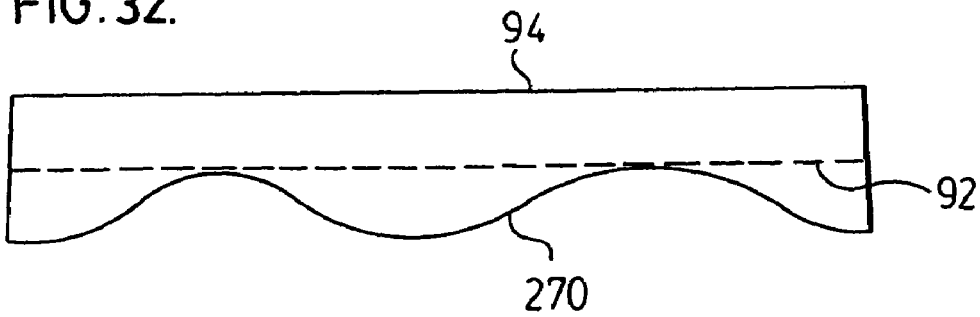
FIG. 32 is an annular cross-sectional view along section line B–B' in FIG. 31.

FIG. 32 illustrates an annular cross-sectional view along section line B-B' in FIG. 31 showing the annular camming ramp 370. When the piston element 78 is inserted to be disposed centered between the fingers 40 and 42 in the desired position, the raised arcuate camming surfaces 250 and 251 engage on the annular camming ramp 270 at diametrically opposed locations and will tend to bias the piston element 78 to rotate to a desired angular orientation in which the overall axial extent of the ramp 370 and the arcuate camming surfaces 250 and 251 are at a minimum.

It is to be appreciated that a piston element 78 could be adopted to assume, for example, the rotating features of each of the embodiments illustrated in FIGS. 23, 26 and 30 or any combination thereof.

The preferred embodiments are shown having two resiliently deformable ribbons of metal acting as finger members, however, the invention is not so limited. Other apparatus and modes for permitting one way coupling of the actuator assembly 30 to the piston element 78 may also be used, including but not limited to, resiliently deformable flanges or prongs adapted to engage corresponding complimentary slits formed in either of a piston element 78 or the actuator assembly.

While the preferred embodiment of the invention as shown illustrates two resiliently deformable substantially parallel finger members, the invention is not so limited. Other combinations and configurations of finger members may equally be used, and will now be apparent.

FIGS. 1 to 5 illustrate two straight locating rods 64*a*, 64*b* to assist in guiding movement of the actuator assembly 30, however, the invention is not so limited. Other means of guiding movement of the actuator assembly, including curved rods to assist in guiding the shoulder member 36 in arcuate movement may also be used. Further, the dispenser may be provided with an actuator assembly characterized by a catch assembly which is carried directly by and adapted for arcuate movement with a pump activating lever permit substantially unhindered axial sliding of the piston element 78 as the catch assembly moves along its arcuate path.

Although the invention has been described with reference to preferred embodiments, it is not so limited. Many variations and modifications will now occur to persons skilled in the art. For a definition of the invention, reference may be made to the appended claims.

We claim:

1. A dispenser for dispensing fluid comprising:

a housing, a removable container insertable into the housing to assume a dispensing position and removable from the housing for replacement, the container carrying a pump having a piston reciprocally slidable along an axis for dispensing fluid from the container with reciprocal axial sliding of the piston, the piston rotatable about the axis, a directional nozzle carried on the piston wherein the piston in desired relative rotational positions about the axis directs fluid from the nozzle over desired angular sectors and in undesired rotational position directs fluid from the nozzle over undesired angular sectors, cam surfaces carried on the piston, camming surfaces carried on the housing, wherein on insertion of the container carrying the pump and its piston into the housing, the cam surfaces and camming surfaces engage to rotate the piston about the axis from undesired rotational positions to desired rotational positions.

2. A dispenser as claimed in claim 1 wherein insertion of the container into the housing, the pump and container are oriented with the axis in a predetermined angulation relative a vertical and in such predetermined angulation, the pump and container are slid linearly relative the housing in an insertion direction normal to the axis, the cam surfaces on the piston comprise surfaces directed radially relative the axis.

3. A dispenser as claimed in claim 1 wherein the piston has a radially outwardly directed flange about which has a circumferential outer surface comprising cam surfaces, the camming surfaces carried on the housing include members carried on the housing for engagement with the cam surfaces carried on the piston when the piston is slid relative to the housing in an insertion direction, the camming surfaces engaging the cam surfaces at cylindrically spaced locations, the camming surfaces disposed spaced from each other a distance less than the greatest diameter through the flange, engagement between at least one of the camming surfaces and cam surface on one half of the flange which extends beyond the cam surface of the other half of the flange urging rotation of the piston about the axis when the piston is slid in the insertion direction relative to the camming surfaces.

4. A dispenser for dispensing fluid comprising, a housing, a reservoir, the housing supporting the reservoir in a dispensing position, the reservoir being insertable into said housing to assume said dispensing position and removable therefrom for replacement, the reservoir comprising:

(i) a chamber for retaining fluid having an outlet, and (ii) a valve mechanism disposed across the outlet for dispensing fluid from the chamber, the valve mechanism comprising a reciprocally movable element for reciprocal movement along an axis relative to the housing when the reservoir is in the dispensing position to dispense fluid, the element including engagement surfaces for engagement with the housing, the housing including an actuator mechanism for actuating the reciprocally movable element, the actuator mechanism movable relative the housing between a first position and a second position, the actuator mechanism including a catch mechanism to engage the engagement surfaces and couple the element to the actuator mechanism, wherein when the reservoir is inserted into the dispensing position, the engagement surfaces and catch mechanism assume relative positions selected from, (a) a coupled orientation in which the catch mechanism engages the engagement surfaces for reciprocal movement of the element to dispense fluid with movement of the actuator mechanism between the first position and the second position, and (b) an uncoupled orientation from which on a first cycling of the actuator mechanism between the first position and the second position, the catch mechanism and engagement surfaces are moved relative to each other that they assume the coupled orientation, the element being rotatable about the axis relative to the housing, the element carrying a directional nozzle, wherein with the element in desired rotational positions relative the axis directs fluid from the nozzle over desired angular sectors and with the element in undesired rotational positions directs fluid from the nozzle over undesired angular sectors, cam surfaces carried on the engagement surfaces of the element, camming surfaces carried on the catch mechanism, wherein when the reservoir is inserted into the housing to assume the dispensing position with the element in an undesired rotational position, the cam surfaces on the engagement surfaces engage the camming surfaces on the catch mechanism to rotate the element from the undesired rotational position to desired rotational positions.

5. A dispenser for dispensing fluid comprising, a housing, a reservoir, the housing supporting the reservoir in a dispensing position, the reservoir being insertable into said housing to assume said dispensing position and removable therefrom for replacement, the reservoir comprising:

(i) a chamber for retaining fluid having an outlet, and (ii) a valve mechanism disposed across the outlet for dispensing fluid from the chamber, the valve mechanism comprising a reciprocally movable element for reciprocal movement along an axis relative to the housing when the reservoir is in the dispensing position to dispense fluid, the reciprocally movable element including engagement surfaces for engagement with the housing, the housing including actuator mechanism for actuating the element, the actuator mechanism movable relative the housing between a first position and a second position, the actuator mechanism including a catch mechanism to engage the engagement surfaces and couple the reciprocally movable element to the actuator mechanism, wherein when the reservoir is inserted into the dispensing position, the engagement surfaces and catch mechanism assume an uncoupled orientation from which on a first cycling of the actuator mechanism between the first position and the second position, the catch mechanism and engagement surfaces are moved relative to each other that they assume a coupled orientation in which the catch mechanism engages the engagement surfaces for reciprocal movement of the element to dispense fluid with movement of the actuator mechanism between the first position and the second position, the element is rotatable about the axis relative to the housing, the element carrying a directional nozzle, wherein with the element in desired rotational positions directs fluid from the nozzle over desired angular sectors and with the element in undesired rotational positions directs fluid from the nozzle over undesired angular sectors, cam surfaces carried on the engagement surfaces of the element, camming surfaces carried on the catch mechanism, wherein on inserting the reservoir into the housing to assume the dispensing position with the engagement surfaces and the catch mechanism in the uncoupled orientation and with the element in an undesired position, the cam surfaces on the engagement surfaces engage the camming surfaces on the catch means to rotate the element from the undesired rotational position to desired rotational positions.

6. A dispenser as claimed in claim 5, the catch mechanism being resiliently to permit movement of the catch mechanism relative the element to facilitate rotation of the element from undesired rotational positions to desired rotational positions.

7. A dispenser as claimed in claim 5, the catch mechanism being resiliently deformable to permit movement of the actuator mechanism relative to the engagement surfaces from the uncoupled orientation to the coupled orientation and to permit movement of the catch mechanism relative the element to facilitate rotation of the element from undesired rotational positions to desired rotational positions.

8. A dispenser as claimed in claim 5 wherein said catch mechanism comprises a first finger member and a second finger member spaced from each other disposed on diametrical locations about the axis, each finger member extending generally parallel the axis, the finger members spaced from each other to define a slotway extending therebetween extending normal to the axis with an entranceway into which the element is slidable normal to the axis for inserting the reservoir into the housing to assume the dispensing position, the slotway extending between the fingers along a central slotway centerline radial to the axis, each finger member having an interior side surface directed into the slotway on each side thereof toward the interior side surface of other finger member to define the slotway therebetween, each finger member having an edge side surface bordering the entranceway extending away from the entranceway, the element having a locating portion with an axial extent, the locating portion having diametrical dimensions which vary about the element angularly about the axis, when the element is in a undesired rotational position the diametrical dimension measured normal the slotway centerline is greater than the spacing of the finger members and on sliding of the locating portion into the entranceway, the locating portion engages the edge side surface of the finger members with such contact imparting rotation to the element to rotate the element toward the desired rotational positions in which the diametrical dimension measured normal the slotway centerline permits the locating portion to be slid past the edge side surfaces and into the slotway.

9. A dispenser as claimed in claim 8 wherein an end portion of each of said first and second finger members resiliently deformable radially relative the axis away from each other.

10. A dispenser as claimed in claim 5 wherein said element comprises a piston forming element, and the engagement surfaces are provided on a circumferential flange extending radially outward from about an outermost end of the piston forming element.

11. A dispenser as claimed in claim 5, wherein said housing further comprises locating means engaging the actuator mechanism to guide movement of the actuator mechanism between the first position and the second position, and biasing means for biasing the actuation mechanism towards the first position, said biasing means comprising a compressed helical spring disposed about said locating means.

12. A dispenser as claimed in claim 5, wherein said fluid comprises an alcohol based liquid.

13. A dispenser as claimed in claim 5, wherein the engagement surfaces are carried on a radially outwardly extending engagement flange having a circumferential outer surface between upper and lower axially directed shoulders, the catch mechanism comprising two resilient deformable fingers disposed diametrically about the flange extending axially from a stop plate and biased radially inwardly into engagement with the circumferentially outer surface;

the fingers having a radially inwardly directed finger flange permitting the engagement flange to slide axially selectively to the fingers from the uncoupled orientation to the coupled orientation in which one of the upper and lower axially directed shoulders engage the stop plate and the finger flange engages the other of the upper and lower axially directed shoulders to prevent movement of the engagement flange axially away from the stop plate;

the fingers and stop plate permitting the engagement flange to slide radially for movement into and out of the dispensing position.

14. A dispenser as claimed in claim 5 wherein said catch mechanism comprises a first locating member and a second locating member spaced from each other disposed on diametrical locations about the axis, the locating members spaced from each other to define a slotway extending therebetween extending normal to the axis with an entranceway into which the element is slidable normal to the axis for inserting the reservoir into the housing to assume the dispensing position, the slotway extending between the locating members along a central slotway centerline radial to the axis, each locating member having an interior side surface directed into the slotway on each side thereof toward the interior side surface of other locating member to define the slotway therebetween, each locating member having an edge side surface bordering the entranceway extending away from the entranceway, the element having a locating portion with an axial extent, the locating portion having diametrical dimensions which vary about the element angularly about the axis, when the element is in a undesired rotational position the diametrical dimension measured normal the slotway centerline is greater than the spacing of the locating member and on the locating portion sliding into the entranceway the locating portion engages the edge side surface of one of the locating members with such contact imparting rotation to the element to rotate the element toward the desired rotational positions in which the diametrical dimension measured normal the slotway centerline permits the locating portion to be slid past the edge side surfaces and into the slotway.

15. A dispenser as claimed in claim 14 wherein each of said first and second locating members more resiliently deformable away from each other.

16. A dispenser as claimed in claim 15 wherein each of said first and second locating members comprise a respective first and second finger member, an end portion of each of said first and second finger members resiliently deformable radially relative the axis away from each other.

17. A dispenser as claimed in claim 16 the locating portion comprises a radially outwardly extending engagement flange having a circumferential outer surface between upper and lower axially directed shoulders.

18. A dispenser as claimed in claim 17, the first and second finger members are disposed diametrically about the engagement flange extending axially from a stop plate and biased radially inwardly into engagement with the circumferential outer surface;

the finger members having a radially inwardly directed finger flange permitting the engagement flange to slide axially selectively relative to the fingers from the uncoupled orientation to the coupled orientation in which one of the upper and lower axially directed shoulders engage the stop plate and the finger flange engages the other of the upper and lower axially directed shoulders to prevent movement of the engagement flange axially away from the stop plate;

the fingers and stop plate permitting the engagement flange to slide radially for movement into and out of the dispensing position.

* * * * *